US005423274A

United States Patent [19]

Benze

[11] Patent Number: 5,423,274

[45] **Date of Patent: * Jun. 13, 1995**

[54] SAILBOAT

[76] Inventor: Theodore A. Benze, 431 Arch St., Carlisle, Pa. 17013

[ * ] Notice: The portion of the term of this patent subsequent to Aug. 3, 2010 has been disclaimed.

[21] Appl. No.: 271,321

[22] Filed: Jul. 13, 1994

Related U.S. Application Data

[63] Continuation-in-part of Ser. No. 97,666, Jul. 27, 1993, Pat. No. 5,392,726, which is a continuation-in-part of Ser. No. 881,158, May 11, 1992, Pat. No. 5,231,943.

[51] Int. Cl.[6] ..... B63H 9/04

[52] U.S. Cl. ..... 114/39.1; 1.4/89; 1.4/97; 1.4/102; 1.4/104

[58] Field of Search ..... 114/39.1, 39.2, 61, 114/89, 90, 102, 103, 104, 97, 123

[56] References Cited

U.S. PATENT DOCUMENTS

| | | | |
|---|---|---|---|
| 24,090 | 5/1859 | Bell . | |
| 163,940 | 6/1875 | Norcross . | |
| 1,375,400 | 4/1921 | Ljungstrom . | |
| 2,147,501 | 2/1939 | Ryder | 114/102 |
| 2,724,356 | 11/1955 | Szakacs | 114/39 |
| 2,893,339 | 7/1959 | Ram | 114/39 |
| 2,944,505 | 7/1960 | Berge | 114/39 |
| 3,150,632 | 9/1964 | Evans | 115/70 |
| 3,173,395 | 3/1965 | Laurent | 114/39 |
| 3,195,494 | 7/1965 | Robin | 114/39 |
| 3,693,571 | 9/1972 | Hiscock | 114/102 |
| 3,960,102 | 6/1976 | Davy | 114/123 |
| 4,044,702 | 8/1977 | Jamieson | 114/102 |
| 4,263,861 | 4/1981 | Vicard | 114/39 |
| 4,449,468 | 5/1984 | Shulz et al. | 114/104 |
| 4,457,248 | 7/1984 | Thurston | 114/39 |
| 4,494,472 | 1/1985 | Rougerie | 114/66 |
| 4,603,648 | 8/1986 | Berge | 114/39 |
| 4,723,498 | 2/1988 | Stampe | 114/102 |
| 4,730,570 | 3/1988 | Harris | 114/61 |
| 4,922,846 | 5/1990 | Biagioli | 114/90 |
| 5,231,943 | 8/1993 | Benze | 114/39.1 |
| 5,235,925 | 8/1993 | Farrier | 114/61 |

FOREIGN PATENT DOCUMENTS

| | | |
|---|---|---|
| 2405187 | 5/1979 | France . |
| 2470046 | 5/1981 | France . |
| 2421791 | 11/1975 | Germany . |

OTHER PUBLICATIONS

EP 94 87 0128 (EPO Search Report), 2 Nov. 1994.

*Primary Examiner*—Stephen P. Avila
*Attorney, Agent, or Firm*—Leonard Bloom

[57] ABSTRACT

A sailing craft having a hull with a longitudinal mid-plane. A primary boom is pivotally mounted on the hull for 360° continuous rotation in either direction about a central vertical axis. The primary boom is connected by lines to a sail boom. At least one angled mast is mounted to the hull and extends upwardly. The mast has a top, the top is disposed approximately above the central vertical axis of the primary boom. A sail is carried by the sail boom and extends upwardly and substantially symmetrically about the central vertical axis. The sail is supported from the top of the at least one mast. The sail boom with the sail thereon has completely free 360° rotation in either direction avoiding contact with the mast. The sail has flake lines swivelably connected to the top of the mast permitting rotation of the sail and flaking of the sail. A tension device maintains tension on the top of the halyard so the sail luff becomes tight when the primary boom rotates either end forward.

11 Claims, 16 Drawing Sheets

SAILBOAT

CROSS REFERENCE TO RELATED APPLICATION

This application is a continuation-in-part of application Ser. No. 097,666, filed on Jul. 27, 1993, (issued as U.S. Pat. No. 5,392,726, Feb. 28 1995) which is a continuation-in-part of application Ser. No. 881,158, filed on May 11, 1992 (issued as U.S. Pat. No. 5,231,943, Aug. 3, 1993), the disclosure of which is incorporated by reference herein in their entireties.

FIELD OF THE INVENTION

The present invention concerns a sail plan for a sailing craft such as a sailboat, and in particular for a sail craft having a three-sided sail mounted on a boom and rotatable about a vertical axis through 360°.

BACKGROUND OF THE INVENTION

The art of sailing has been practiced for thousands of years and is generally well known throughout the world. Most sailing craft utilize one or more masts which project upwardly from the hull and have at least one sail attached thereto. In small boats which are operated by one person, the need to constantly adjust the setting of the sail with respect to the direction of the wind while controlling the rudder and handling the various lines associated with the boom and the sail, is a difficult and strenuous operation.

Various sails and mast configurations have been proposed and used to attempt to simplify the operation of sailing craft and/or to improve the efficiency of the sailing craft. The applicant is aware of the following which are considered pertinent to the present application.

| Inventor(s) | U.S. Pat. No. |
|---|---|
| Bell | 24,090 |
| Norcross | 163,940 |
| Ljungstrom | 1,375,400 |
| Ryder | 2,147,501 |
| Szakacs | 2,724,356 |
| Laurent | 3,173,395 |
| Robin | 3,195,494 |
| Hiscock | 3,693,571 |
| Jamieson | 4,044,702 |
| Berge | 4,603,648 |
| Stampe | 4,723,498 |
| Biagioli | 4,922,846 |

Bell discloses a shortened mast bench set at a greater than standard angle to the horizontal plane. A spar having upwardly curved ends is secured to the mast. The mast is connected to the mast bench. A single sail or separate sail may be fitted to the mast.

Norcross discloses a mast composed of two or more timbers which are joined at their tops by a common cap. The bottoms of the masts are mounted to a revolving platform which is received in a socket in the deck.

Ljungstrom discloses a mast which can be inclined together with the sail, either ahead or astern in the longitudinal direction of the boat. The lower end of the mast is attached to rollers running on a curved bar.

Ryder discloses a triangular sail which is rotatable 360° about a single center mast, mounted amidship. The mast is an assemblage of several parts.

Szakacs discloses a single curved mast mounted on the stern of the boat. A triangular sail is attached to the mast. The sail is framed by a strip of wood on the foot and by steel cables on the sides.

Laurent discloses a triangular sail mounted to a center mast of a catamaran and rotatable 360° about the mast. The mast is supported by shrouds which are mounted fore and aft. The rudders and the sail are controlled from the center of the boat.

Robin discloses a sail control for vessels wherein a sail rig includes a flexible sail membrane, drawn taut within a triangular, peripheral frame by means of cables and operated by winches. The sail may rotate through 360°. The frame is connected to the hull and is slidably mounted on guide rails. The frame may also pivot about a base.

Hiscock discloses a sail rig for many types of vessels including a monohull, a catamaran, a trimaran, a hydrofoil, an ice boat, and a land yacht. The sail is symmetrical and is a spherical isosceles triangle with a curved leach, a curved luff, and a curved foot. A boom is provided to swing freely about the lower end of the luff spar, and a sail is mounted with its foot adjacent to the boom and its luff adjacent to the luff spar.

Jamieson discloses a single sail suspended at its head from the apex of a tripod mast. The foot of the sail is attached to a spar. The spar is rotatably mounted atop a stub mast which is centrally located witch respect to the tripod mast.

Berge discloses a catamaran type sailboat with several inclined mast-like elements which have a common upper connection. The masts are pivotable at their lower ends.

Stampe discloses two masts with a common thwartships plane which are joined at a mast head. Each mast is provided with a respective main boom and two main sails.

Biagioli discloses a masting which comprises three (3) poles to form a pyramid with a triangular base and connected upper ends at the vertex. The masting also comprises a plurality of stays to which sails are applied. The boat may be a catamaran.

Thus, despite interest in sails over a period of many years, there still exists a need for a simple system for a sail which enables a sailing craft to be operated by one individual with a minimum of effort and which provides increased maneuverability to the sailing craft.

Further, the simplified sail permits the design of the sailing craft to be simplified and improved so that the sailing craft can be more easily handled under various conditions of wind.

SUMMARY OF THE INVENTION

A principal object of the invention is to provide a plan for a sail on a sailing craft which provides increased maneuverability to the sailing craft.

It is another object of the present invention to provide a plan for a sail on a sailing craft, wherein the lower edge of a sail is connected to a boom, the boom being pivotable about a midpoint wherein pressure on the edges of the sides of the sail can be equalized.

It is yet another object of the present invention to provide a sail attached to a boom rotatable in either direction through 360°, which when rotated through 180°, forward and aft are reversed and luff and leach interchange.

It is a further object of the present invention to provide a sailing craft having a swivel plate attached to the top of the mast and flake lines extending vertically through the sail, the swivel plate preventing entanglement of the flake lines when the sail rotates 360° in either direction.

In accordance with the teachings of the present invention, there is disclosed a sailing craft having at least one hull. The hull has a bow and a stern in a longitudinal midplane. A primary boom is pivotally mounted on the at least one hull for 360° continuous rotation in either direction about a central vertical axis. A sail boom is connected to the primary boom. At least one angled mast is mounted on the at least one hull, extending upwardly therefrom. The at least one mast has a top, the top being disposed approximately above the central vertical axis of the primary boom. A sail is carried by the sail boom, the sail extending upwardly therefrom, and substantially symmetrical about the central vertical axis. The sail is supported from the top of the at least one mast, such that the sail boom with the sail thereon has a completely free 360° rotation in either direction avoiding contact with the at least one mast.

In further accordance with the teachings of the present invention, the hull of the sailing craft further has a deck, a port side and a starboard side. A cam having a base is mounted on the hull deck at the central vertical axis. The cam is oriented toward the stern and disposed above the primary boom. The primary boom rotates about the base of the cam. The sail boom has a first end and an opposite second end. A first cam line is connected from the cam to the first end of the sail boom. A second cam line is connected from the cam to the second end of the sail boom. When the primary boom rotates in a first direction, the first cam line is tightened and the second cam line is slackened, and when the primary boom rotates in a second opposite direction, the second cam line is tightened and the first cam line is slackened. In this manner, the luff and leach of the sail are interchangeable when the primary boom rotates through 180°.

In still further accordance with the teaching of the present invention, the sail has a top, a foot and two sides therebetween, the foot being broader than the top. The foot of the sail is attached to the sail boom. A swivel plate is attached to the top of the mast. A pair of sail flake lines are provided, each sail flake line having a first end and a second end. The first ends of each sail flake line are attached to the swivel plate. A plurality of spaced-apart openings in the sail are disposed in two parallel columns oriented from the top of the sail to the foot of the sail. Each sail flake line passes through the openings In a respective column. The second ends of the respective flake lines are attached to the sail boom, wherein entanglement and twisting of the flake lines are avoided when the sail rotates through 360° in either direction.

These and other objects of the present invention will become apparent from a reading of the following specification, taken in conjunction with the enclosed drawings.

DESCRIPTION OF THE PREFERRED EMBODIMENTS

Figure 1:
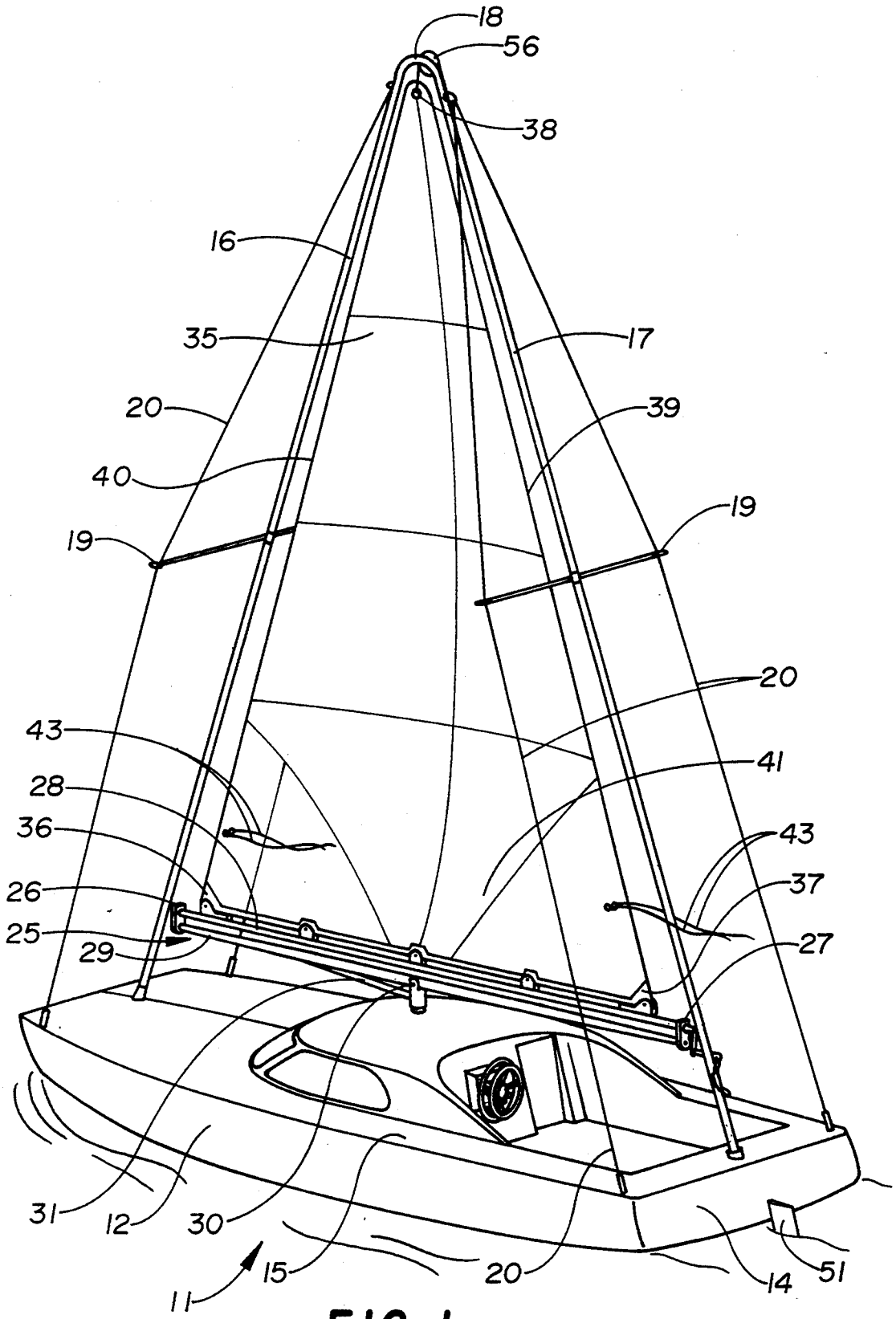
FIG. 1 is a perspective view of a sailboat having the sail plan of the present invention.

Referring now to the FIGS. 1–6, the sailboat 11 has a hull 12 which has a bow 13 and a stern 14 in the longitudinal plane of the hull 12 and an amidships 15 between the bow 13 and the stern 14. A forward mast 16 is mounted near the bow 13 of the hull 12, and an aft mast 17 is mounted near the stern 14 of the hull 12. Both masts 16, 17 are mounted in a manner so that the tops of the masts are angled inwardly, and the respective tops 18 of the masts 16, 17 are joined at a juncture at a point above the hull 12. Preferably, each mast 16, 17 further has a cross member 19 attached thereto between the hull 12 and the top 18. The cross member 19 is substantially perpendicular to the respective mast 16, 17 and the ends extend outwardly from each mast 16, 17 toward the port and starboard sides such that the cross members 19 are substantially parallel to the plane of the hull 12. To support the masts 16, 17, shrouds 20 are connected to each mast. One end of each shroud 20 is connected to the top 18 of the respective mast 16, 17, and the intermediate section of the shroud 20 is attached to the end of the respective cross member 19. The other opposite ends of the respective shrouds 20 are connected to the hull 12 at the port and starboard edges of the hull 12 adjacent to the mounting of the respective forward and aft masts 16, 17. In this manner, the masts 16, 17 are securely supported to the hull 12.

Figure 2:
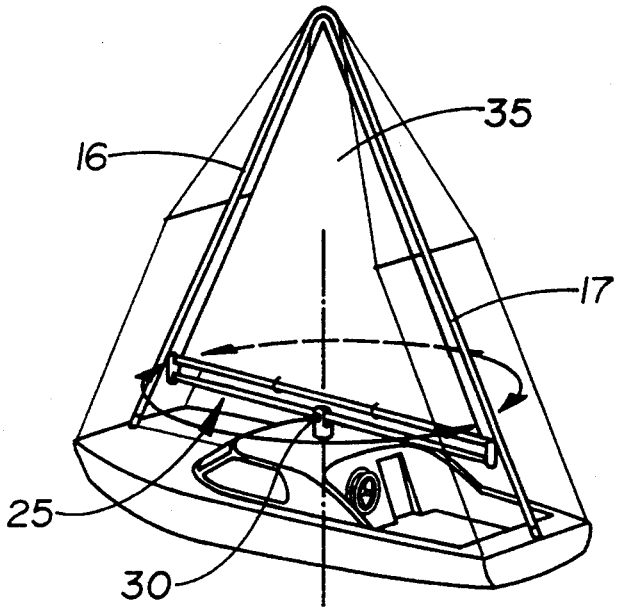
FIG. 2 is a perspective view of a sailboat showing 360° rotation of the sail of the present invention.
Figure 4:
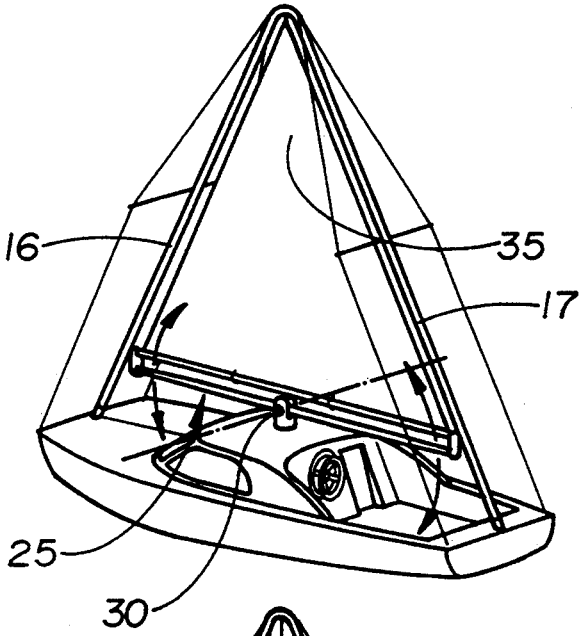
FIG. 4 is a perspective view of a sailboat showing pivotal mounting of the boom of the present invention.
Figure 3:
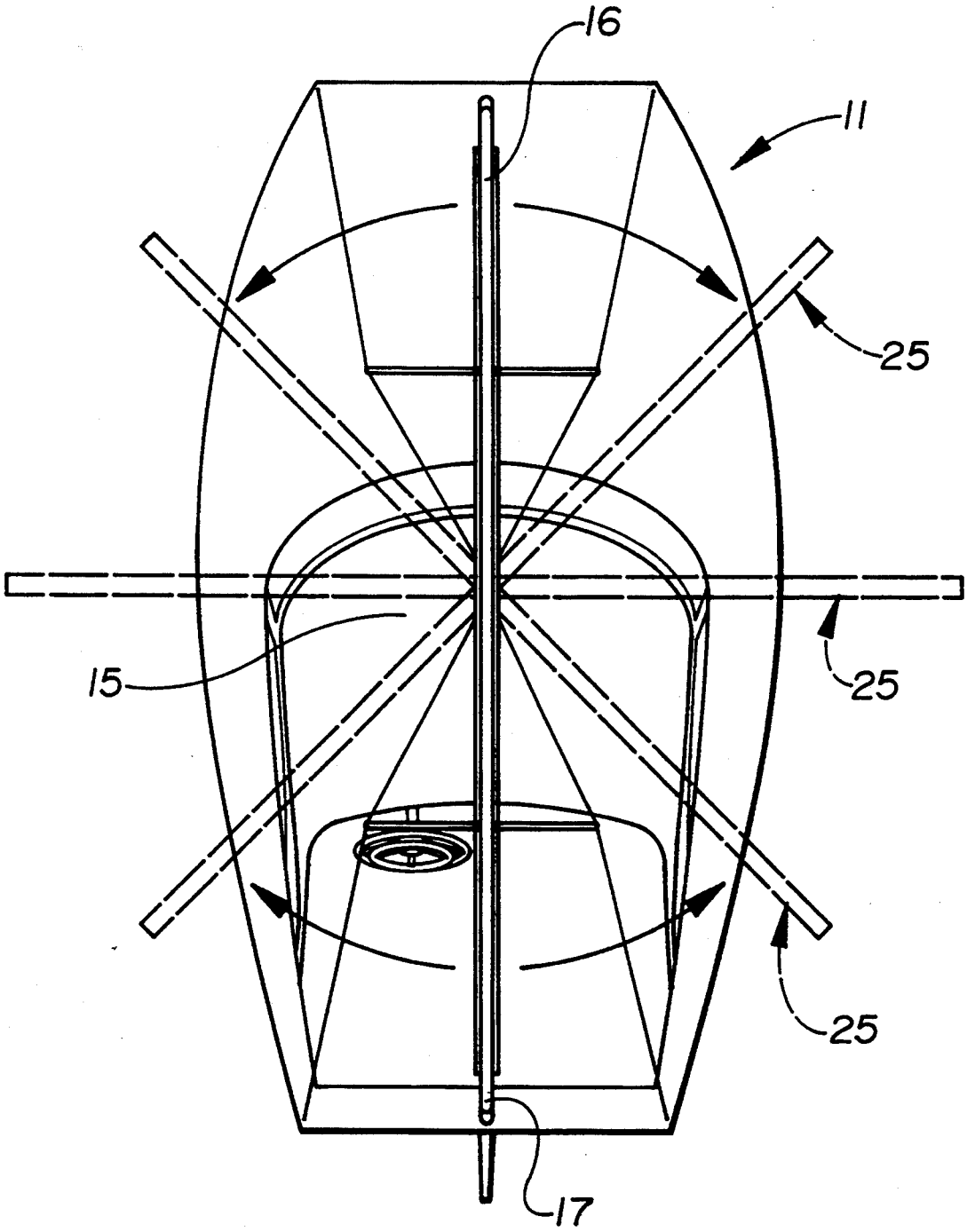
FIG. 3 is a top plan view showing 360° rotation of the sail having the rotational positions in phantom lines.

A boom 25 having a first end 26 and a second end 27 is mounted approximately amidships 15 of the hull 12. The mounting is also approximately at the midpoint between the port and starboard sides of the hull 12. The midpoint of the boom 25 is rotatably mounted on the hull 12 in a manner whereby the boom 25 may rotate about a vertical axis through 360° in a plane parallel to the plane of the hull. The length of the boom 25 is less than the distance between the masts 16, 17 in the plane of rotation such that the ends 26, 27 of the boom 25 avoid contact with the masts 16, 17 (FIGS. 2, 3). In a preferred embodiment, the boom 25 is formed of an upper member 28 and a lower member 29 which are connected at the ends thereof so that the ends of the respective members 28, 29 are also the ends 26, 27 of the boom 25. The midpoint of the boom 25 is further pivotally mounted at the point 30 at which the boom 25 is rotatably mounted. In this manner, the boom 25 may also pivot above and below a plane parallel to the plane of the hull 12 throughout the entire 360° rotation of the boom 25 (FIG. 4).

A boom vang 31 may be connected between the boom 25 and the axle 47. The boom vang 31 is an adjustable connector which may be tightened or loosened. The boom vang 31 limits the movement of the boom 25 and the sail 35 attached thereto in both the rotational and the pivotal modes. The boom vang permits the shape of the sail 35 to be controlled since, when secured in a desired position by the boom vang 31, the amount of air being spilled from the sail 35 can be controlled.

Figure 5:
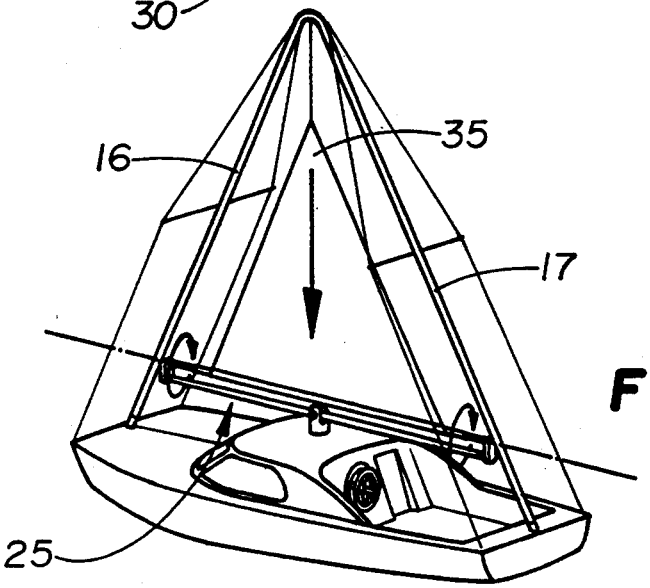
FIG. 5 is a perspective view of a sailboat showing lowering of the sail of the present invention.
Figure 6:
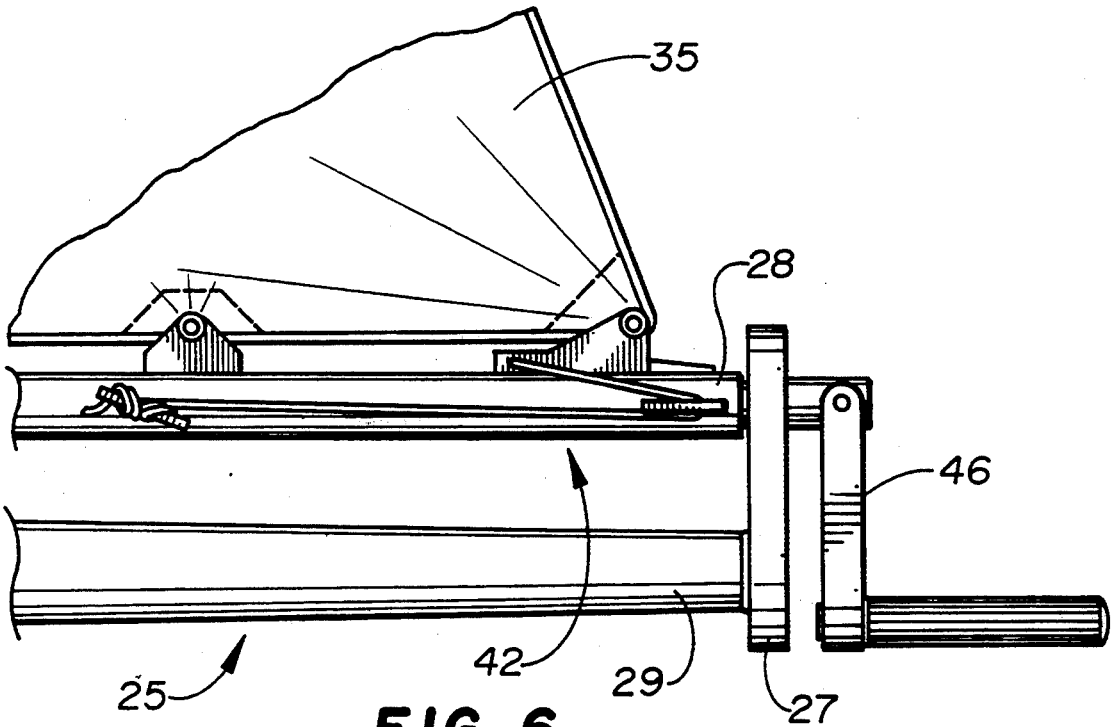
FIG. 6 is a side view showing outhauling of the corner of the sail.
Figure 7:
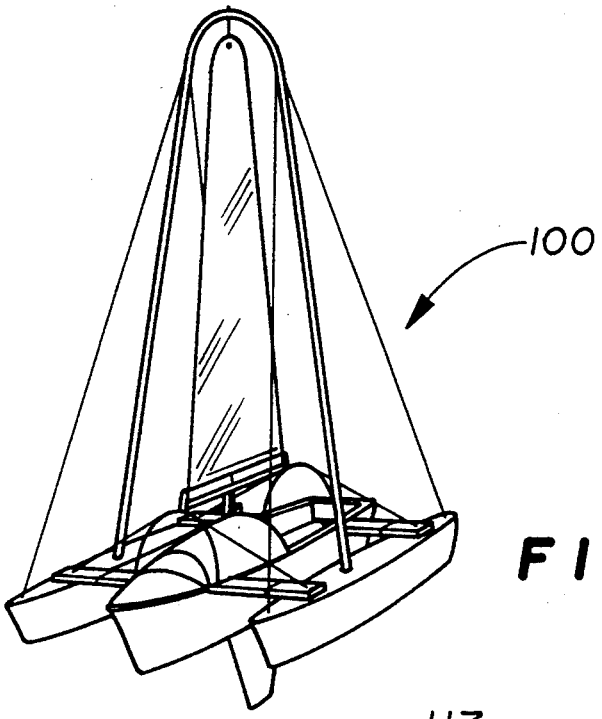
FIG. 7 is a perspective view of a tri-hulled sailing craft of the present invention.

A triangular sail. 35 having a first corner 36, a second corner 37, a third corner 38, and side edges 39, 40 is mounted on the boom 25. The sail 35 is made of fabric, polyester, or similar material commonly used on sail boats or wind-powered vehicles, The foot 41 of the sail 35 is the side of the sail 35 which is between the first corner 36 and the second corner 37 and is disposed adjacent to the length of the boom 25. The third corner 38 of the sail 35 is movably mounted to the juncture at the top 18 of the masts 16, 17 in a manner whereby the third corner 38 of the sail 35 can be raised and/or lowered (FIG. 5). The first and second corners 36, 37 of the sail 35 are movable laterally and are connected to the respective first end 26 and second end 27 of the boom 25 by outhauls 42 as are known to persons skilled in the art (FIG. 6). Preferably, the corners 36, 37 of the sail 35 are attached to outhauls 42 on the upper member 28 of the boom 25. The lateral movement of the corners of the sail 25 permits the sailor to set the bag of the sail 25 by having a greater or lesser cup in the sail.

A pulley means is preferably mounted at the top 18 of the mast 12 and a halyard. 45 is passed through the pulley. One end of the halyard 45 is connected to the third corner 38 of the sail and the halyard 45 is disposed along the mast, preferably the aft mast 17. The opposite end of the halyard 45 is releasably wrapped about a cleat or the like, preferably mounted on the mast 17 near the hull 12 so that the sailor may rapidly and easily be able to raise and/or lower the sail 35 by pulling or releasing the halyard 45.

In another embodiment (FIGS. 7–19), the sail plan may be used on a sailing craft 100 having a center hull 101, an outboard port hull 102 and an outboard starboard hull 103. The port hull 102 and the starboard hull 103 are adjustably connected to the center hull 101 by respective port and starboard bridge beams 104, 105 as will be described. Each hull 101, 102, 103 has a respective top surface (deck) and a respective keel with a respective vertical plane therebetween. The port hull 102 and the starboard hull 103 may be moved and secured to a position adjacent to the center hull 101 for storage. In this configuration, the sailing craft 100 may be mounted on a trailer for transport. In this disposition, the three hulls 101, 102, 103 are in a substantially vertical position and the vertical planes are substantially parallel (as shown in the broken lines in FIG. 8). The hulls 101, 102, 103 are in a seaworthy position and, when placed in the water, the keels are in the water and the decks are above the water. The port hull 102 and the starboard hull 103 may be moved outwardly from the center hull 101 and secured in an outward position for sailing.

Figure 8:
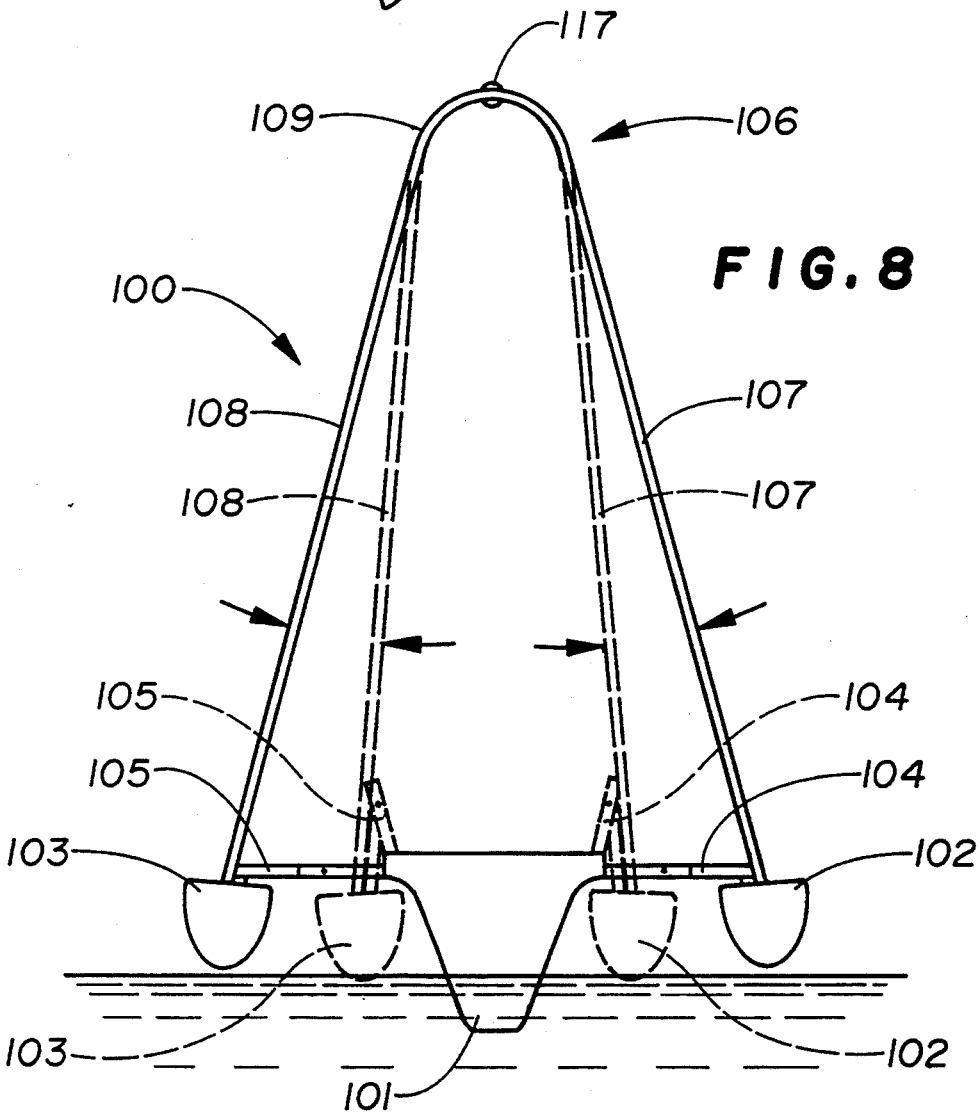
FIG. 8 is a front plan view of the invention of FIG. 7 showing the outboard hulls extended outwardly and, in broken lines, showing the outboard hulls moved inwardly adjacent to the center hull.

An inverted U-shaped mast 106 has a port leg 107 and a starboard leg 108 connected at an arcuate top 109. Preferably, the legs 107, 108 are separate members joined at the arcuate top 109 in a manner such that the ends 110, 111 of the legs 107, 108 are parallel to one another and may be moved radially apart from one another. The U-shape mast 106 is stored on the deck 112 of the center hull 101 in the longitudinal plane which extends from the bow 113 to the stern 114 of the center hull 101. Securing means such as a bracket are located on the port side 115 and the starboard side 116 of the center hull 101, at approximately amidships between the bow 113 and the stern 114, to retain the mast 106 on the center hull 101 during transport of the sailing craft 100. When the sailing craft 100 is prepared for sailing, the U-shaped mast 106 is removed from the storage position and stepped up to an upright position. The end 110 of the port leg 107 is removably connected to a fitting on the port hull 102 and the end 111 of the starboard leg 108 is removably connected to a fitting on the starboard hull 103. The connection may be a bracket on the respective hull with a threaded bolt through the bracket and through an opening in the respective leg 107, 108 of the mast 106 secured by nut cooperating with the threaded bolt. Other removable connectors may be used. In this manner, the mast 106 is supported approximately amidships of the sailing craft 100, the mast 106 extending from port to starboard and not being in contact with the center hull 101. If desired, a stay may be connected from the ends of the mast 106 to the top 109 of the mast 106 for additional support. The port hull 102 and the starboard hull 103 are disposed outwardly from the center hull 101 as will be described. The legs 107, 108 of the mast 106 form an acute angle so that the vertical planes of the port hull 106 and the starboard hull 107 are each disposed at an acute angle with respect to the vertical plane of the center hull 101. In this manner, as the sailing craft 100 heels to port, the plane of the port hull 106 is oriented vertically (plumb) with respect to the surface of the water and the starboard hull 107 is elevated above the welter. Similarly, if the sailing craft 100 heels to starboard, the starboard hull 107 is oriented vertically (plumb) with respect to the surface of the water and the port hull 108 is elevated above the water (FIG. 8).

The top of the mast 109 may have a float means 117 attached which may be a foam material, an air inflatable container or other means which prevents the top of the mast 109 from sinking in the water. Thus, if the sailing craft 100 were to capsize for any reason, the float means would maintain the top of the mast 109 at the surface of the water and prevent the sailing craft from being completely inverted (turning turtle).

Figure 9:
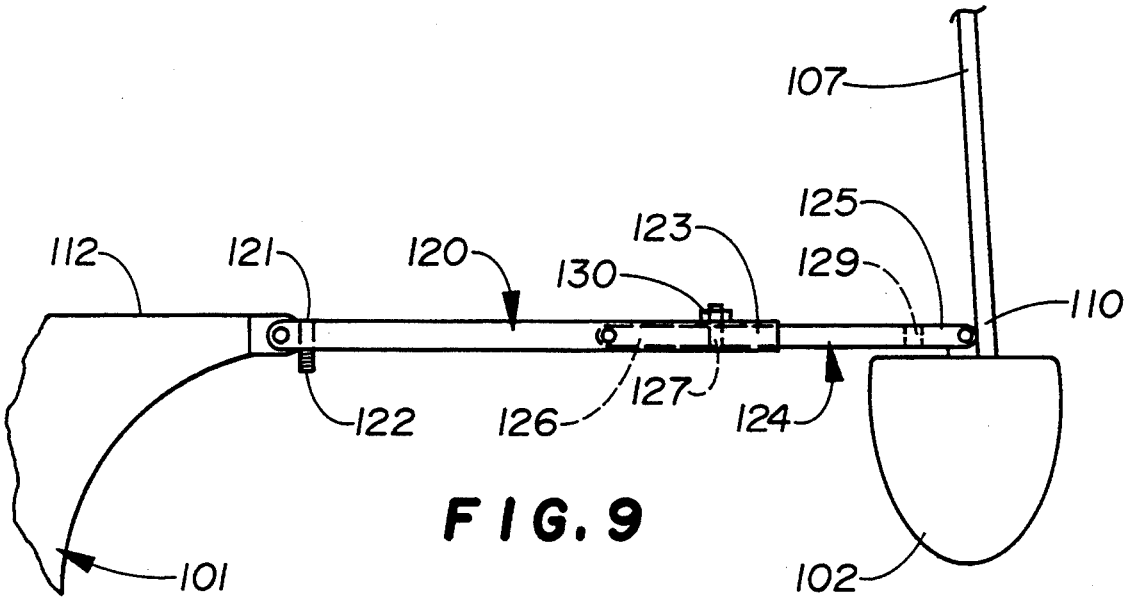
FIG. 9 is a front plan view of the port bridge beam in its extended position. The starboard bridge beam is not shown but is the mirror image of the port bridge beam.
Figure 10:
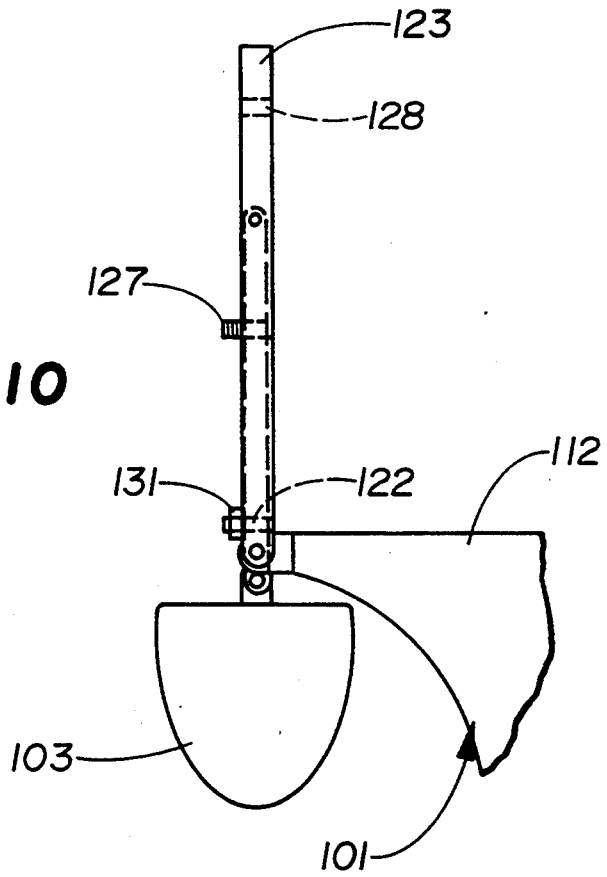
FIG. 10 is a front plan of the starboard bridge beam in its folded position. The port bridge beam is not shown but is the mirror image of the starboard bridge beam.
Figure 11:
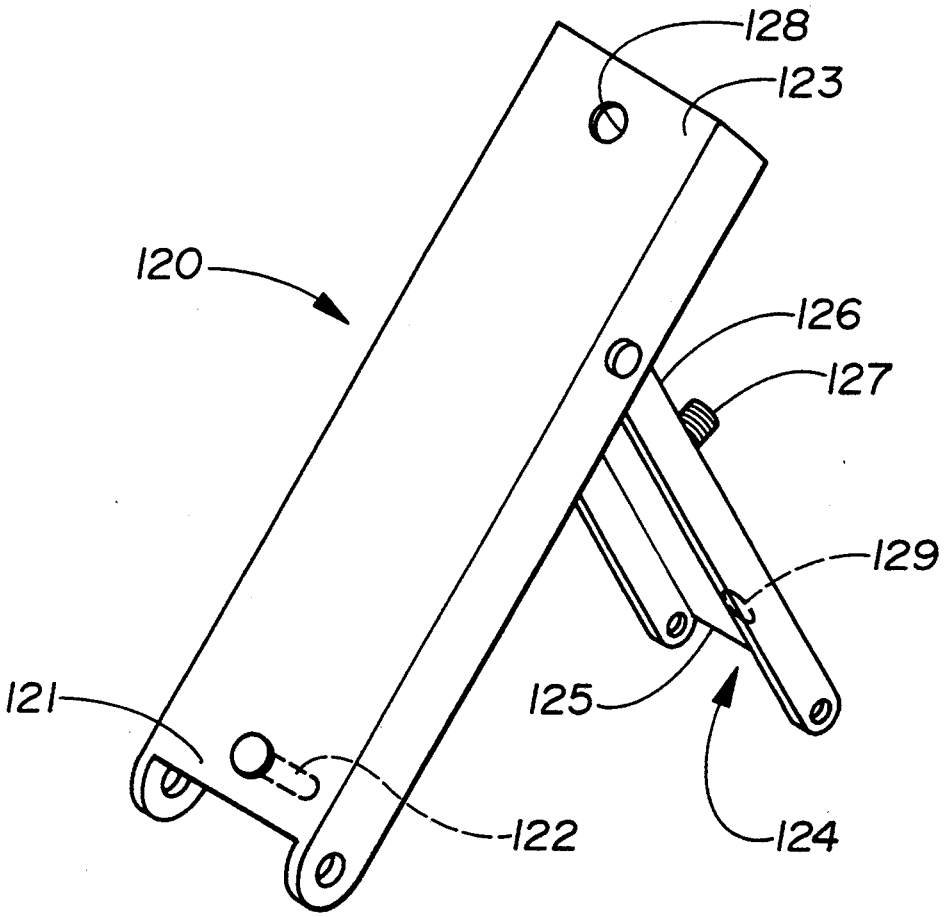
FIG. 11 is a perspective view of the bridge beam in a partially folded position.

As seen in FIGS. 9–11, the bridge beams 104, 105 each have a first arm 120 which each have an inboard end 121. The inboard end 121 of each bridge beam 104, 105 is hingedly connected to the center hull 101 respectively on the port and starboard sides 115, 116. A first threaded bolt 122 is perpendicularly connected near the inboard ends 121 of the respective first arms 120. Each threaded bolt 122 is oriented outwardly from the center hull 101 when the respective first arm 120 is hingedly moved to an upright position with respect to the center hull 101. The first arm 120 also has an opposite outboard end 123. The bridge beams 104, 105 further each have a respective second arm 124 each having a first outboard end 125. The outboard end 125 of each bridge beam 104, 105 is hingedly connected to the port hull 102 and the starboard hull 103 respectively. The second arms 124 are shorter in length than the first arms 120. The inboard ends 126 of the respective second arms 124 are hingedly connected to approximately the midpoint of the respective first arms 120. A second threaded bolt 127 is perpendicularly connected near the outboard end 125 of each second arm 124. The second threaded bolts 127 are oriented upwardly and outwardly from the respective port and starboard hulls 102, 103. A first opening 128 is formed near the outboard end 123 of each first arm 120, and a second opening 129 is formed near the outboard end 125 of each second arm 124. When the port hull 102 and the starboard hull 103 are moved outwardly from the center hull 101, the first arm 120 of each bridge beam 104, 105 is disposed in the longitudinal plane of the center hull 101 and is substantially perpendicular to the center hull 101. The second threaded bolt 127 on the second arm 124 is received in the first opening 128 near the outboard arm 123 of the first arm 120 and the second threaded bolt 127 near the inboard end 121 of the first arm 120 is oriented downwardly toward the keel of the center hull 101. A first cooperating threaded means 130 (such as a nut or a wing nut) is removably connected to the second threaded bolt 127 to secure the first arm 120 to the respective outboard hull 102, 103 in a seaworthy position.

The first threaded means 130 may be removed from the second threaded bolt 127 and the respective outboard hulls 102, 103 may be moved adjacent to the center hull 101 for storage or transport. The inboard end 121 of the first arm 120 hingably folds upright to a position approximately perpendicular with respect to the longitudinal plane of the center hull 101 with the outboard end 123 of the first arm 120 extending upwardly from the deck 112 of the center hull 101. The inboard end 126 and the outboard end 125 of the second arm 124 hingably folds so that the second arm 124 is moved to a position substantially parallel to the first arm 120. In this manner, the first threaded bolt 122 near the inboard end 121 of the first arm 120 is received in the second opening 129 in the outboard end 125 of the second arm 124. A second cooperating threaded means 131 (such as a nut or wing nut) is removably connected to the first threaded bolt 122 to secure the respective outboard hull 102, 103 adjacent to the center hull 101. If desired, the first cooperating threaded means 130 may be interchangeable with the second cooperating threaded means 131 and one means may be used with both threaded bolts. A threaded means is preferred but other connecting means known to persons skilled in the art may be used.

It is preferred that four (4) bridge beams be provided, two on the starboard side (fore and aft) and two on the port side (fore and aft) to provide increased stability and strength to the sailing craft 100. It is also preferred that the forward bridge beams be diametrically opposed to one another and that the aft bridge beams be diametrically opposed to one another.

It is preferred that the first arms 120 be formed of U-shaped channels for increased strength and rigidity. It is further preferred that the second arms 124 also be formed of U-shaped channels which are narrower than the channels of the first arms 120 so that the second arms 124 may be received in the channel of the first arm 120.

Figure 12:
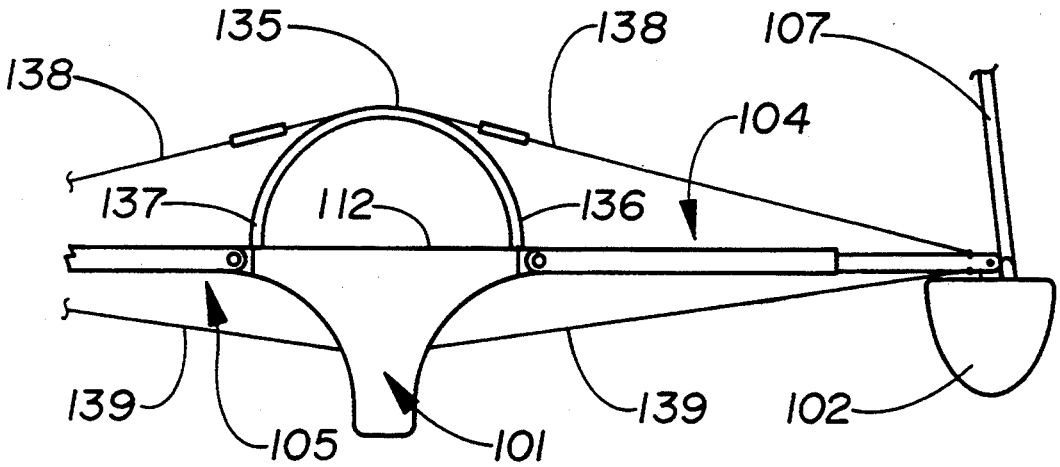
FIG. 12 is a front plan view showing the arched member on the center hull, the extended bridge beam connecting the port hull in its outboard position and cable bracings between the arched member and the bridge beam. The connection to the starboard hull (not shown) is the mirror image hereof.

Two arched members 135 are provided, each having a port end 136 and a starboard end which are connected to the deck 112 on the respective port side 115 and starboard side 115 of the center hull 101 (FIG. 12). One arched member 135 is mounted forwardly adjacent to forward bridge beams 104, 105 and the other arched member 135 is mounted aft adjacent to the aft bridge beams 104, 105, Upper cable bracings 138 are connected from the arched member 135 to the bridge beam 104, 105 near the respective outboard hulls 102, 103 and lower cable bracings 139 are connected from the center hull 101 to the bridge beam 104, 105 near the respective outboard hulls 102, 103. The cable bracings 138, 139 are provided port and starboard, forward and aft on the respective arched members 135 and adjacent bridge beams 104, 105. The cable bracings 138, 139 provide additional support and stability to the port and starboard hulls 102, 103 when the hulls are disposed outwardly in the sailing position.

Figure 13:
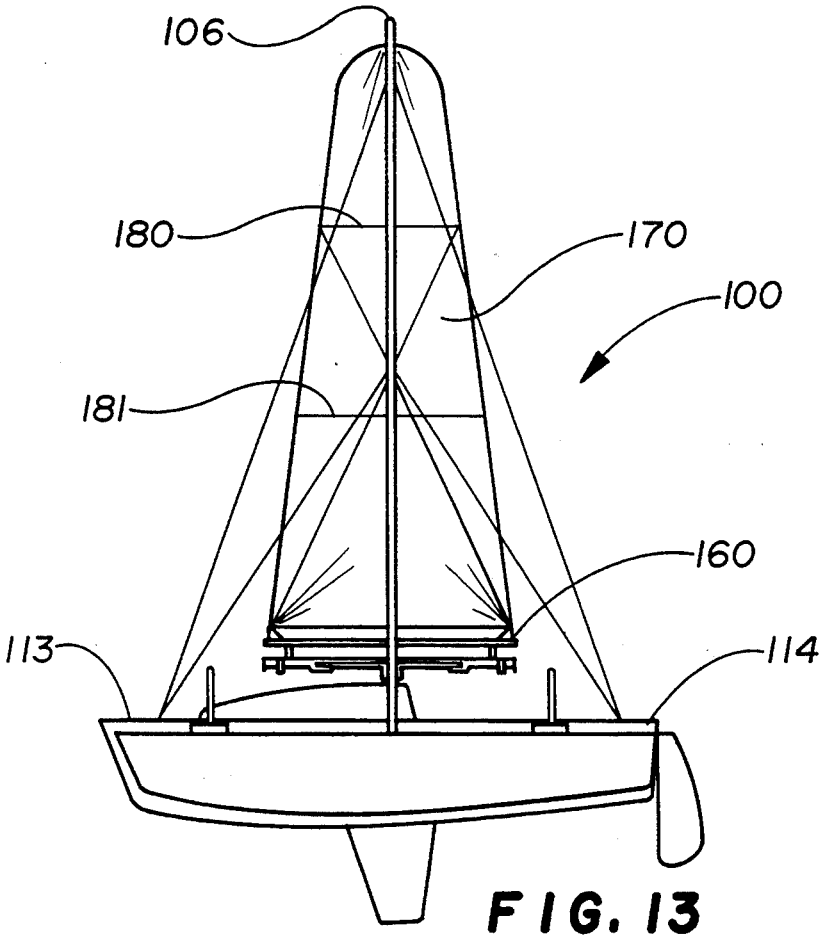
FIG. 13 is a side elevation view of the sailing craft of FIG. 7.
Figure 14:
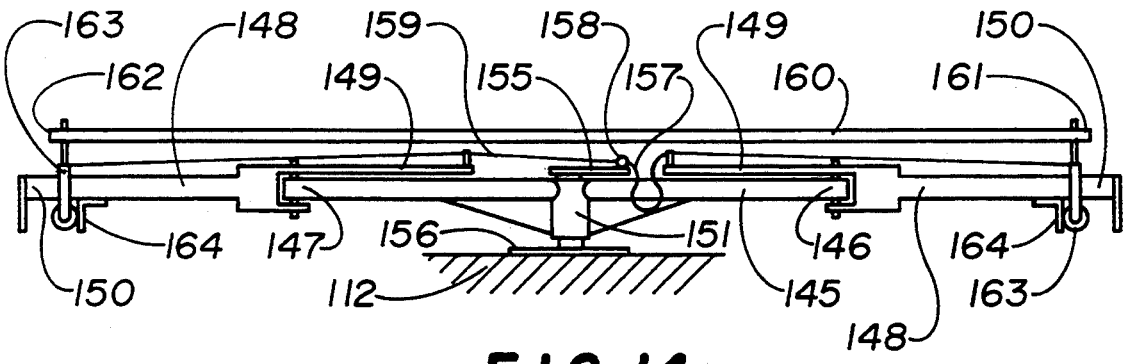
FIG. 14 is an enlarged side elevation view showing the rotating primary boom, the articulating booms and the sail shape boom.

As seen in FIG. 13, primary boom 145 is rotatably mounted on the deck 112 of the center hull 101 approximately amidships and between the port leg 107 and the starboard leg 108 of the mast 106 (when the mast 106 is disposed on the port hull 102 and starboard hull 103). In this manner, the primary boom 145 is approximately centered fore to aft and port to starboard of the sailing craft 100. The primary boom 145 is rotatable through 360° about a rotary axis, the primary boom 145 being in a plane parallel to the longitudinal plane of the center hull 101. As shown in FIG. 14, the primary boom 145 has a first end 146 and an opposite second end 147. A pair of secondary articulating booms 148 are pivotally connected to the respective ends 146, 147 of the primary boom 145. Each articulating boom 148 has a first inward end 149 oriented toward the center of the primary boom 145 and a second opposite outward end 150 oriented away from the center of the primary boom 145.

The primary boom 145 preferably has a center shaft 151 connected perpendicularly to the midpoint of the boom 145 and rotatably connected to the deck 112 of the center hull 101. Preferably, the center shaft 151 is hollow.

Figure 15:
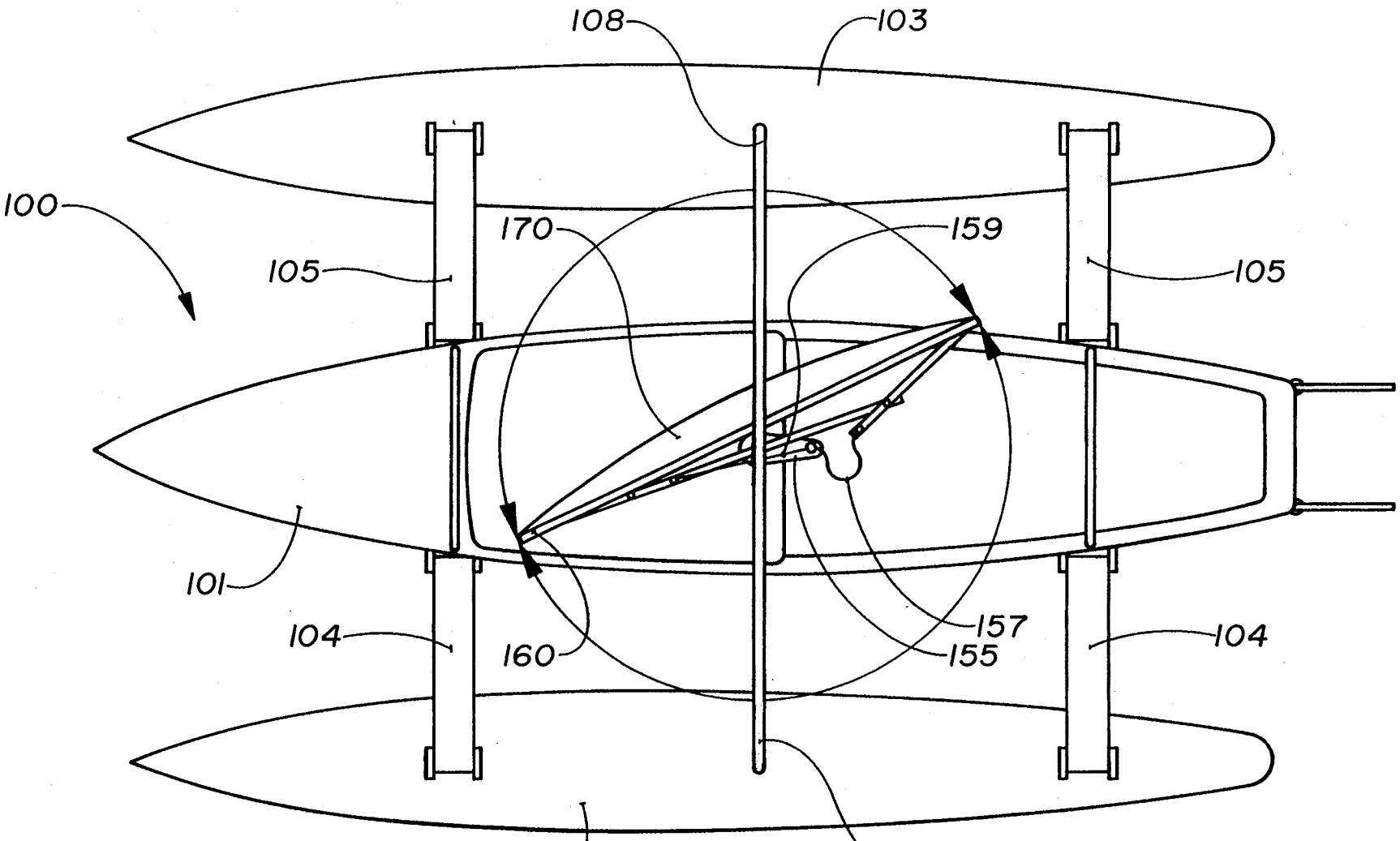
FIG. 15 is a top, plan view showing diagrammatically, the rotation of the booms within the mast and articulation of the articulating booms.

A cam 155 has a wider rounded end and an opposite narrower end. The base 156 of the cam 155 is mounted on the deck 112 of the center hull 101. Preferably, the cam 155 has a shaft extending upwardly through the hollow center shaft of the primary boom 145. In this manner, the cam 155 is above the midpoint of the primary boom 145 on the center line of the center hull 101 and the narrower end of the cam 155 is oriented toward the stern 114 of the sailing craft 100. The primary boom 145 may rotate about the cam 155. Referring to FIGS. 14–15, a first line 157 has one end connected to the cam 155 at a juncture point 158. The first line 157 slidably passes through an eye on the inward end 149 of one of the articulating booms 148. The other end of the first line 157 is connected to the outward end 150 of the one of the articulating booms as will be described. A second line 158 has one end connected to the cam 155 at the same juncture point 158. The second line 158 slidably passes through an eye on the inward end 149 of the other articulating boom 148. The other end of the second line is connected to the outward end 150 of the other of the articulating booms 148 as will be described. When the primary boom 145 rotates in a first direction, the first line 157 is tightened becoming the luff and the second line 159 is slackened such that one of the articulating booms is pivoted about the respective end of the primary boom 145. When the primary boom 145 rotates in a second, opposite direction, the second line 159 is tightened becoming the luff and the first line is slackened such that the other articulating boom is pivoted about the respective end of the primary boom 145. In this manner, the forward end and the aft end of the primary boom 145 and of the articulating booms 148 are interchangeable as the booms rotate.

A sail shape boom 160 has a first end 161 and an opposite second end 162. The first end 161 of the sail shape boom 160 is slidably connected to the outward end 150 of one of the articulating booms 148 and the second end 162 of the sail shape boom 160 is slidably connected to the outward end 150 of the other of the articulation booms 148. The connection is by a trolley 163 on each of the articulating booms 148 whereby, as the primary boom 145 rotates and the articulating booms 148 pivot due to the respective other ends of the lines 157, 159 being connected to the respective trolleys 163, the respective trolleys travel laterally along the respective articulating boom 148. In this manner, stress on the sail shape boom 160 is reduced and the articulating booms 148 may pivot while remaining connected to the sail shape boom 160. Further, each articulating boom 148 has a stop means 164 formed between the outward end 150 of the respective boom and the pivotal connecting to the primary boom 145. The stop means 164 limits the inward travel of the respective trolley 163. The stop means 164 may be a protrusion on the surface of the articulating boom or any other means known to persons skilled in the art to prevent continuing lateral travel by the trolley 163.

The sail shape boom 160 is disposed in a longitudinal plane above the longitudinal plane of the rotating primary boom 145 and the articulating boom 148 attached to the primary boom 145. When the primary boom 145 rotates through 360°, the articulating booms 148 and the sail shape boom 160 also rotate through 360°. The ends 161, 162 of the sail shape boom 160 and outward ends 150 of the articulating booms 148 avoid contact with the mast 106.

Figure 16:
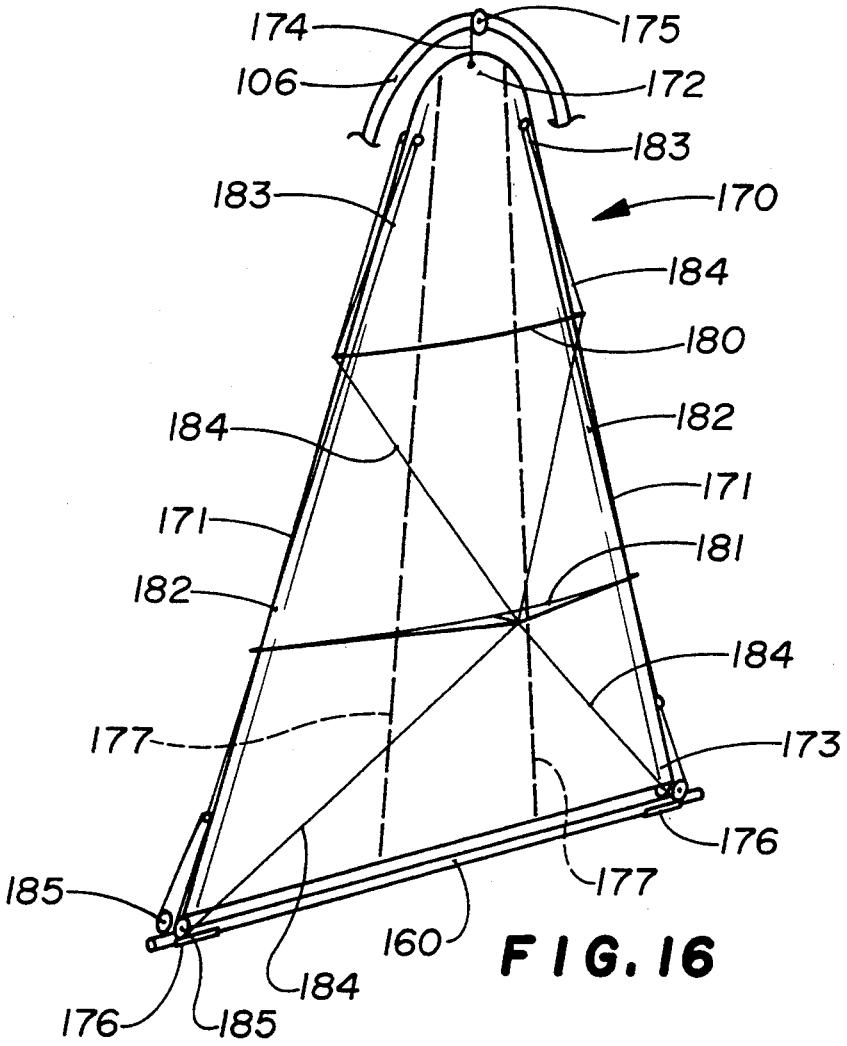
FIG. 16 is a side elevation view of the sail mounted within the mast showing the wishbone spars, the sail lines and the support lines.
Figure 17:
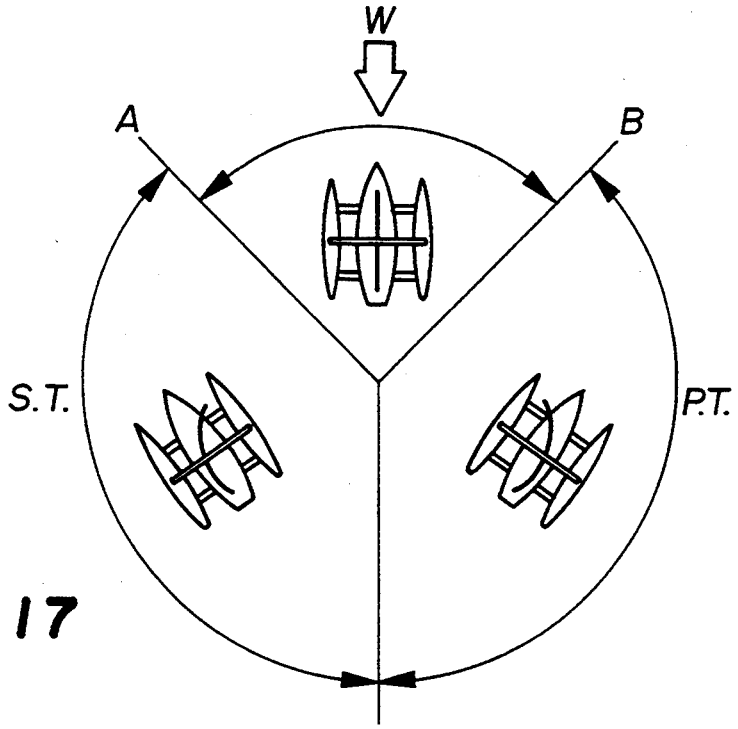
FIG. 17 is a front view of the sail showing the wishbone spars, the sail lines and the support lines.
Figure 18:
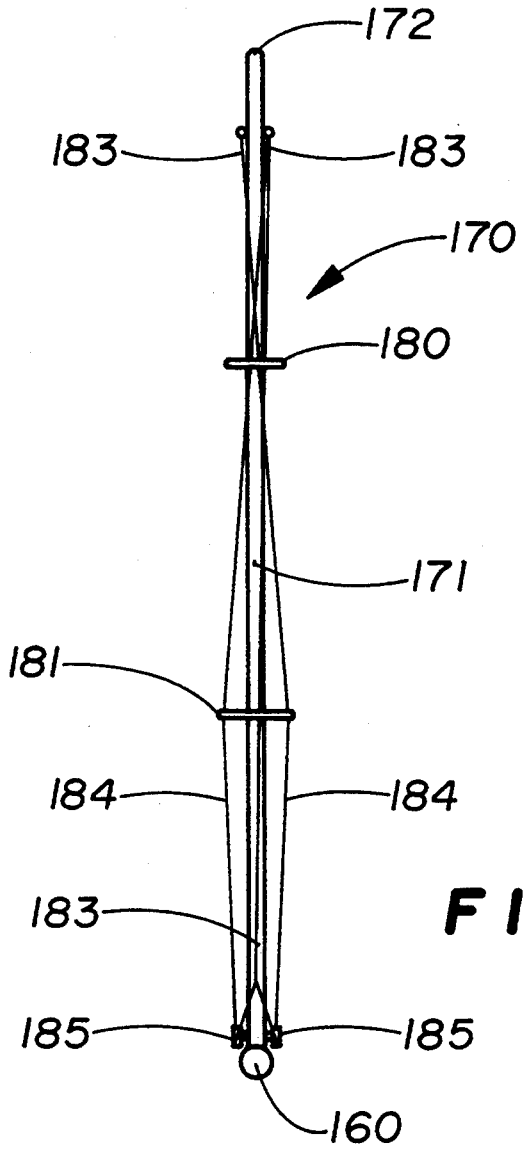
FIG. 18 is a top plan view of the sail showing the wishbone spar, the sail lines and the support lines.
Figure 19:
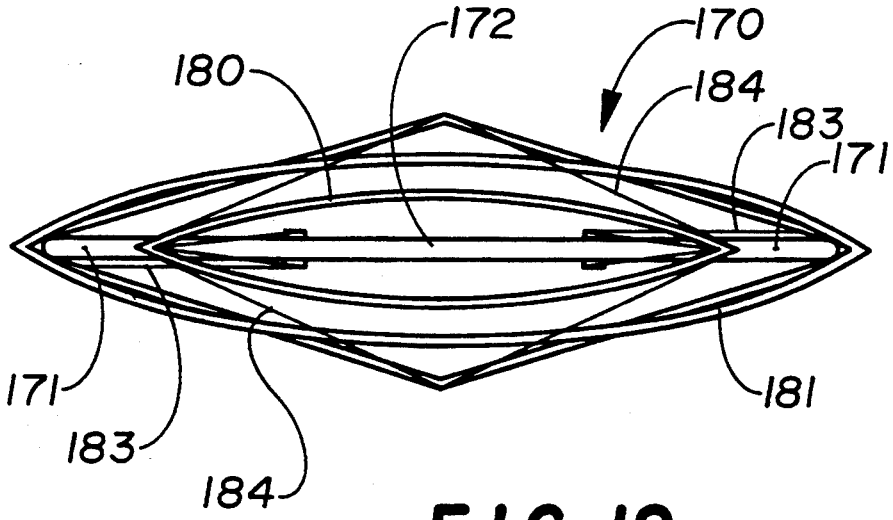
FIG. 19 is a diagram showing sailing of the sailing craft of the present invention with respect to the wind.

Referring to FIG. 16–18, a sail 170 having at least two edges 171, a head 172 and a foot 173 is mounted within the mast 106 and avoiding contact with the mast 106. The sail 170 is symmetrical about a vertical axis. The head 172 of the sail 170 is releasably attached to the top 109 of the mast 106. Preferably a halyard 174 is connected to the head 172 of the sail 170, the halyard 174 passing through a pulley means 175 attached to the top 109 of the mast and continuing along the mast 106 to near the end of one of the legs of the mast where the halyard 174 may be secured to a cleat. Pulling downwardly on the halyard 174 raises the sail 170 and releasing the halyard 174 lowers the sail 170. The amount of tension on the sail 170 can be adjusted by use of the halyard 174 depending upon the intensity of the wind. The foot 172 of the sail 170 is connected to the sail shape boom 160. The corners at the foot of the sail 170 are attached by an outhaul 176 to permit lateral movement for the sail 170. A pair of spaced-apart downhaul lines 177 are connected to the sail 170 and extend from near the head 172 of the sail 170 to the foot 173 of the sail 170. The downhaul lines 177 further are each connected to the sail shape boom 160 and provide additional support for the sail.

An upper wishbone spar 180 is connected laterally to the sail near the head 172 of the sail 170 and a lower wishbone spar 181 is connected laterally to the sail 170 at approximately the center of the sail 170 between the head 172 and the foot 173. A hem 182 is formed on each edge 171 of the sail 170. A separate sail line 183 is connected on each edge 171 of the sail 170 near the head 172 of the sail 170, each sail line 183 passing downwardly through the hem 182 on each respective edge 171 of the sail 170 to a point near the foot 172 of the sail 170. Each sail line 183 exists from the respective hem 182 and is separated into two separate support lines 184, thereby forming four support lines 184. Each support line 184 passes through a respective support pulley 185. Two support pulley 185 are connected to the first end 161 of the sail shape boom 160 and two additional support pulleys 185 are connected to the second end 162 of the sail shape boom 160. Each support line 185, after passing through the respective support pulley 185 is angled upwardly and inwardly over the sail 170 to the lower wishbone spar 181 at a point on approximately the vertical axis of the sail 170. The respective support lines 185 are each slidably connected to the lower wishbone spar 181 and are further angled upwardly and outwardly to a slidable connection to the upper wishbone spar 180 at a point near the respective edge 171 of the sail 170. Each support line 185 is further extended upwardly and is connected to the respective edge 181 of the sail 170 at approximately the point where the respective sail lines 183 are connected to the edge 171 of the sail 170. In this manner, two support lines 185 are disposed over one surface of the sail 170 and two support lines 185 are disposed over the opposite surface of the sail 170. Each support line 185, thus extends from the support pulley 185 to form a triangular shape over a surface of the sail 170 and along a respective edge 171 of the sail 170. In this manner, a total of four triangular shapes are formed. The four triangular configurations, together with the two wishbone spars 180, 181 and the two sail lines 183 maintain the sail 170 so that twisting of the sail 170 is reduced, the luff and leach alignment of the sail 170 is maintained and the shape of the sail 170 is controlled by even tension produced throughout the sail 170 and applied by the halyard 174.

In operation, FIG. 17 when the port hull 102 and the starboard hull 103 are disposed in the outboard position and secured by the bridge beams 104, 105, the sail 170 is mounted within the port to starboard disposition of the legs 107, 108 of the mast 106 and the sail 170 avoids contact with the mast 106. When one of the articulating booms 148 is in the forward position and is on the direct center line (fore to aft) of the sailing craft 100, the other articulating boom 148 articulates enough to allow the sailing craft 100 to tack, close haul, port PT or starboard tacking ST (when the wind is on the port side or starboard side respectively), without any other contact being made with the booms or the sail 170. The luff and the leach of the sail 170 are interchangeable and the sailing craft 100 passes through the wind without stalling the sailing craft 100 by backloading the sail 170 even when sailing into the wind (arrow W). When a sail craft of a conventional design is sailing before the wind (running), the sail is on one side of the craft. To change direction of travel, but still going downwind, the sail must be "flipped" across the boat and reloaded on the other side, thereby "jibing". This places a strain on rigging, masts and passengers. A fast swinging boom has produced many a bump on the head of a passenger and has de-masted many a boat. Sailing craft of conventional designs are unable to sail downwind without jibing between the points A and B shown in FIG. 17. However, due to the structure described herein, the sailing craft of the present invention is able to sail under these wind conditions without having to jibe or stall. The articulating booms limit boom swing while the craft is sailing through the wind while preventing backloading on the sail. The 360° of sail rotation allows the sail to be kept fully loaded through any downwind maneuver without ever needing to jibe.

Figure 21:
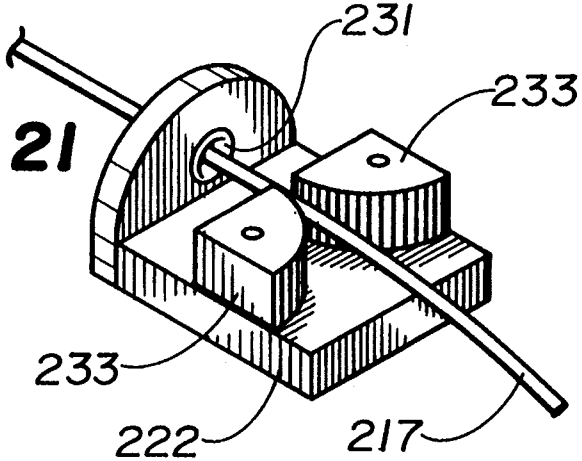
FIG. 21 is a perspective view of the cam cleat.
Figure 20:
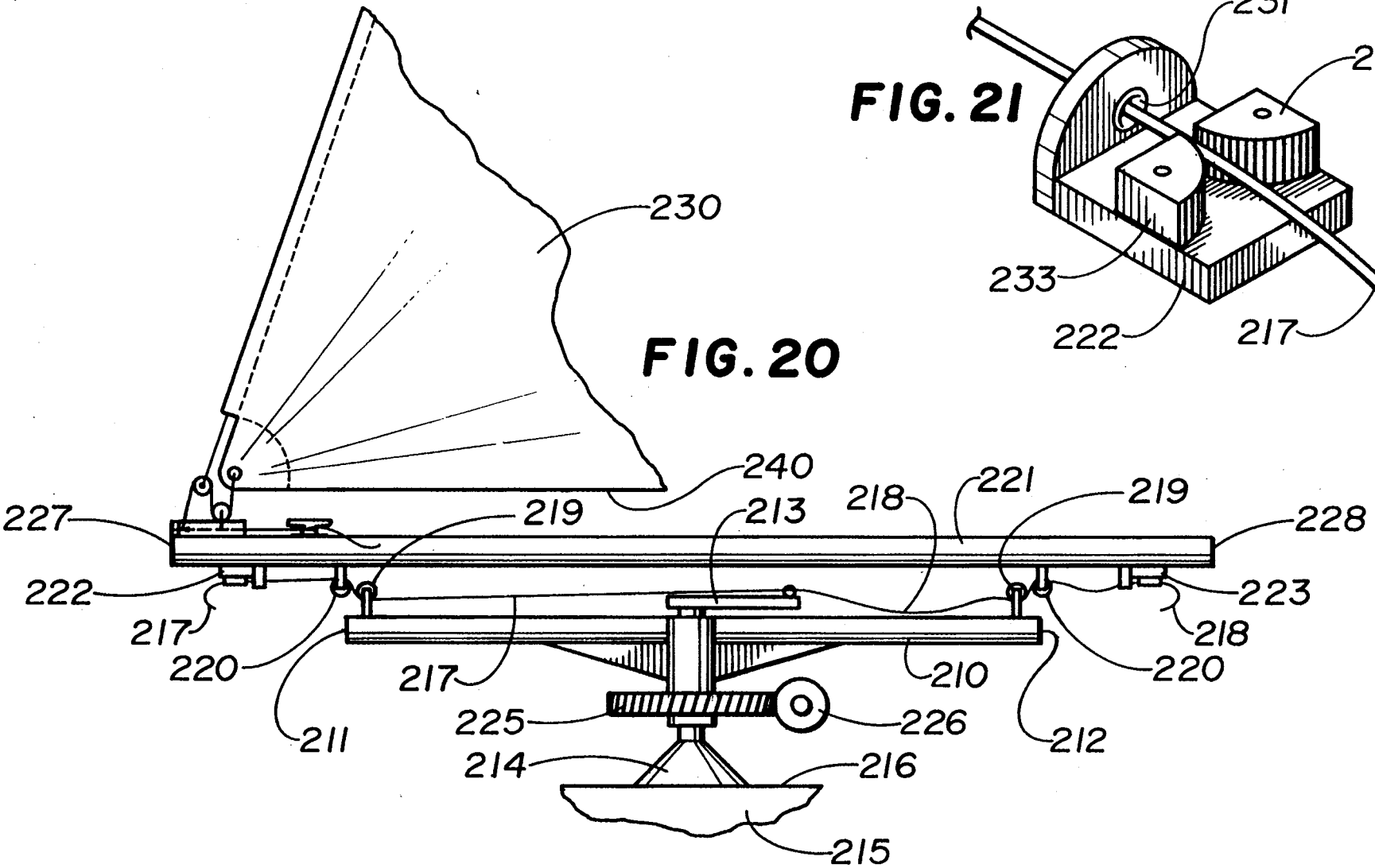
FIG. 20 is a side elevation view showing an alternative embodiment of the rotating primary boom, the cam, the sail boom and a portion of the sail.

In an alternate embodiment (FIGS. 20–21), the primary boom 210 has a first end and an opposite second end 212. The primary boom 210 is mounted approximately amidship of the hull 215 and on the center line between port and starboard of the hull 215. As such, the primary boom 210 is approximately at the center of gravity of the sailing craft. The primary boom 210 is freely rotatable about a vertical axis through 360° in either direction in a plane parallel to the horizontal plane between the bow and stern of the sailing craft.

A cam 213 has a cam base 214 mounted on the deck 216 of the hull 217. The cam 213 is oriented toward the stern of the sailing craft and is approximately above the midpoint of the primary boom 210 with the primary boom 210 rotatable about the cam base 214. A first cam line 217 and a second cam line 218 are connected to the cam. Each cam line 217, 218 extends toward respective opposite ends 211, 212 of the primary boom 210 and preferably passes through a pulley or guide 219 near the respective end 211, 212. The respective cam lines 217, 218 further pass through a pulley or guide 220 connected to the sail boom 221. The respective cam lines 217, 218 are further extended through respective cam cleats 222, 223 as will be described.

The shaft of the primary boom 210 passes through a ring gear 225. The teeth of the ring gear 225 are interconnected with teeth of a worm gear 226. The worm gear 226 is capable of being driven by hand or by motor in both clockwise and counter-clockwise directions. No brake is required to maintain the gear train at a selected setting. The gear arrangement may be used to rotate the primary boom 210, and set the sail boom 221 and the sail 230 connected thereto to desired or selected orientations with respect to the wind and to the hull.

The sail boom 221 to which the sail 230 is connected, is disposed above the primary boom 210 and has a first end 227 and an opposite second end 228. The cam cleats 222, 223 are mounted near the ends 227, 228 of the sail boom and preferably on the underside of the sail boom 221 opposite the primary boom 210. Each cam cleat 222, 223 has an alignment eye 231 and a pair of opposed jaws 233. The jaws 233 preferably have interconnecting teeth smooth sides. The respective cam lines 217, 218 pass through the respective alignment eyes 231 and through the respective jaws 233, the cam lines 217, 218 extending outwardly from the cam cleats 222, 223. Pulling downwardly on the extending cam lines 217, 218 releases the jaws 233 in the cam cleats 222, 223 and permits the sail boom 221 to pay out in an emergency knockdown situation. In this situation, it would be too slow to rotate the sail 230 by mechanical means and without the cam cleat quick release, it is possible that the sailing craft could capsize. This knockdown situation is a problem only when the sailing craft is sailing close to the wind and the primary boom 210 is approximately aligned along the center line of the hull. When so aligned, the cam cleat and cam line is approximately directly above the helm permitting easy access to the person at the helm.

Figure 22:
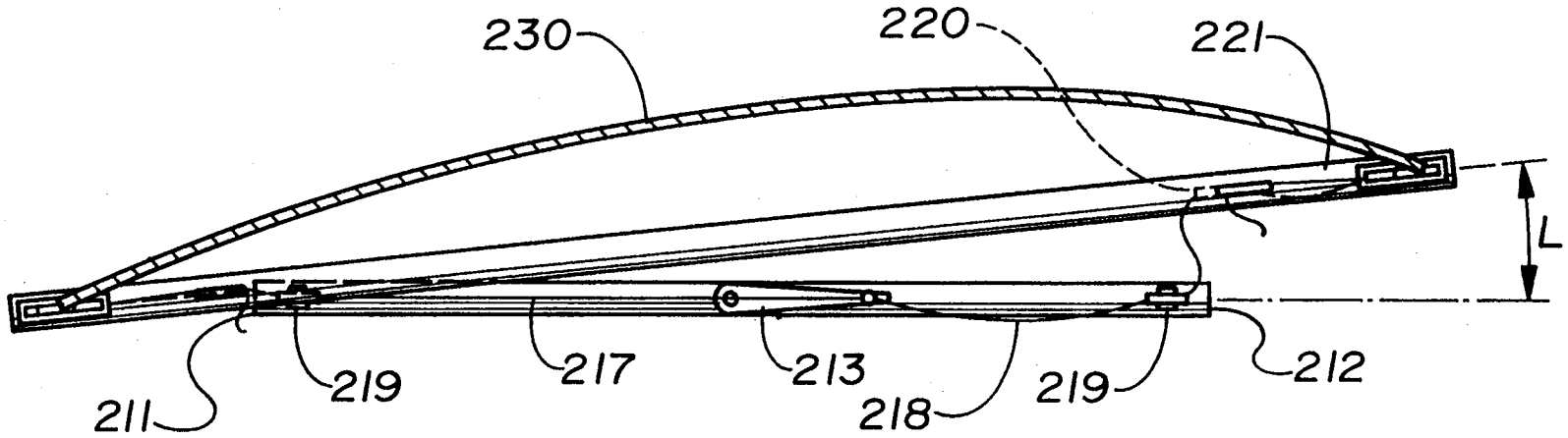
FIG. 22 is a top plan view of the sail and sail boom disposed over the primary boom and showing the slack in one of the cam lines.

When the primary boom 210 is approximately aligned with the center line of the hull, the cam line 217, 218 to the end of the primary boom 210 which is oriented forward toward the bow, is taut and the cam line 217, 218 to the end of the boom 210 which is oriented aft toward the stern, is slack. This permits the sail boom 221 and the sail 230 attached thereto, to move to port or starboard of the center line by a predetermined distance, the distance being a function of the length of the slackened cam line. This length (see L in FIG. 22) is sufficient for tacking of the sailing craft without rotation of the primary boom. In this manner, the sail 230 is self-tending. When the primary boom 210 rotates through 180°, the forward and aft orientation are reversed and the luff and leach of the sail 230 interchange. The sailing craft continues sailing without interruption by the self-tending feature and no action is required by the sailor on board the sailing craft.

Figure 23:
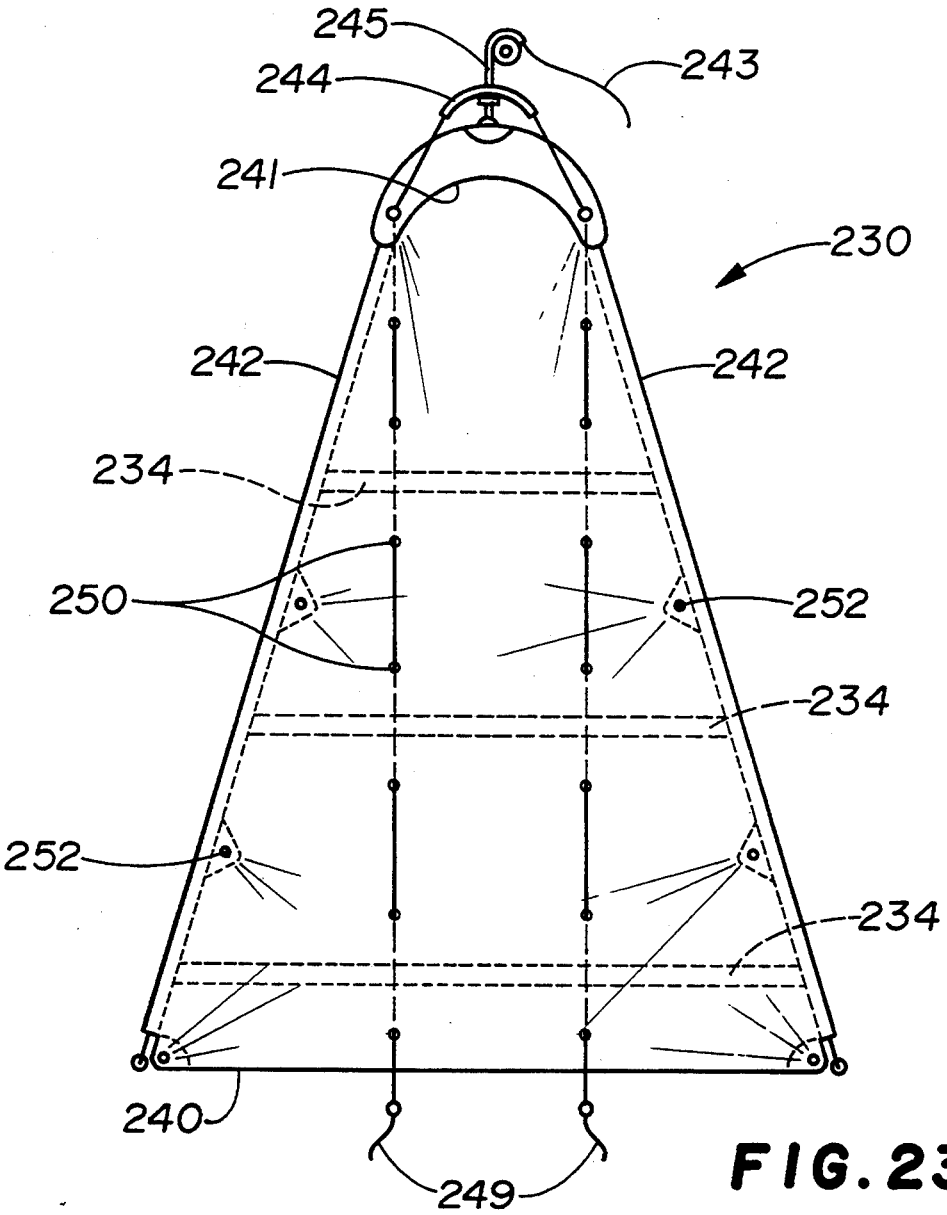
FIG. 23 is a side elevation view of an alternate embodiment of the sail.
Figure 24:
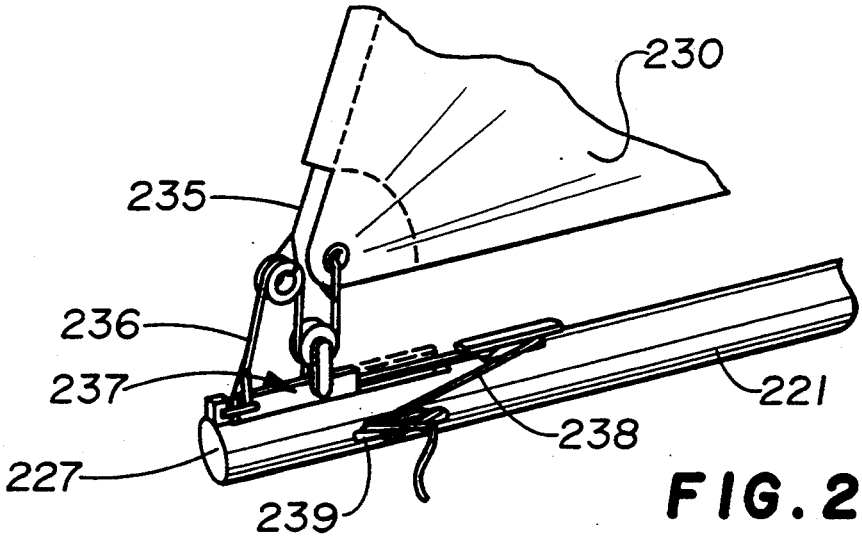
FIG. 24 is an enlarged perspective view of the connection of the sail to the sail boom.

Referring now to FIG. 23, the sail 230 has a foot 240, a top 241 and two sides 242, therebetween. The foot 240 is broader than the top 241 and the sail 230 is symmetrical about the vertical axis of the primary boom 210. The foot 240 of the sail 230 is connected to the sail boom 221 at each end 227, 228 of the sail boom 221. A combination of pulley and lines are used to connect the sail 230 to each end the sail boom 221 (FIG. 24). A luff tension line 235 is disposed along each side 242 of the sail. The top of each luff line 235 is connected to the top of the sail 241 and tension on the halyard 243 (as described below) tightens each luff line 235 and removes wrinkles from the sail 230. The bottom of the luff line 235 is connected to the top of a pulley. A sail tension equalizer line 236 passes through the pulley with one end of the sail tension equalizer line 236 attached to an outhaul slider 237 and the other end of the line 236 passing through a second pulley attached to the outhaul slider 237 and connected to a corner of the sail 230. The outhaul slider 237 slidably movable along the length of the sail boom 271 as shown by the broken lines. The outhaul slider 237 has an outhaul line 238 connected thereto, passing through a cheek block pulley mounted on the sail boom 221 and being directed backwardly to an outhaul cleat 239 mounted on the sail boom 221 near the outhaul slider when the sail 230 is loaded by the wind, the outhaul slider 237 tends to move inwardly, away from the end 227, 228 of the sail boom 221. Thus, only inward movement needs to be limited by the outhaul line 238 to set the amount of draft or "bag" in the curvature of the sail for optimal power to drive the sailing craft forward.

A halyard 243 is connected to the top of the sail 241. Preferably, the halyard passes through a swivel plate 244, through a hollow halyard tube 245 and is routed down the mast 247 to a halyard cleat 251. The swivel plate 244 is connected to the top of the mast 247 and the first ends of two flake lines 249 are connected to the swivel plate 244. The flake lines 249 are threaded through a series of openings 250 formed in the sail 230. Preferably, a grommet is disposed about each opening to prevent wear and tear of the opening. The openings 250 are spaced apart in two parallel columns oriented from the top of the sail 241 to the foot of the sail 240 with one flake line 249 passing through a respective column. The second end of each flake line 249 is secured to the sail boom 221. The flake line 249 may be tied to the sail boom 221 or connectors or attachment means may be used. Thus, when the sail boom 221 and sail 230 are rotated through 360°, the flake lines 249 are not twisted or entangled but remain separate and aligned within the sail 230.

Figure 28:
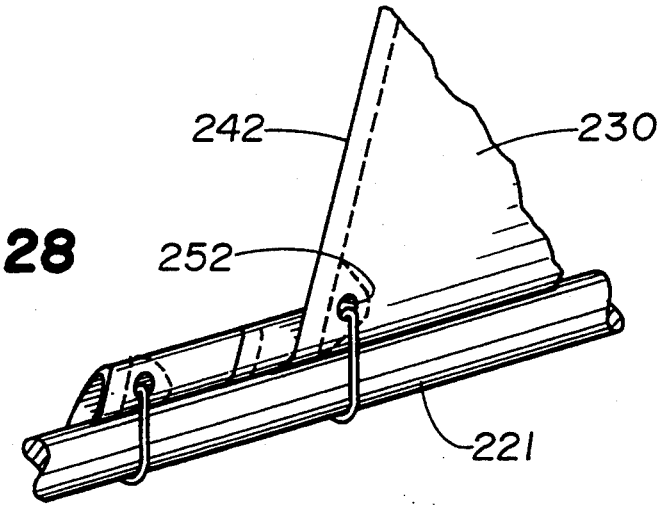
FIG. 28 is a perspective view showing reefing ties through the reef points to reef the sail.
Figure 25:
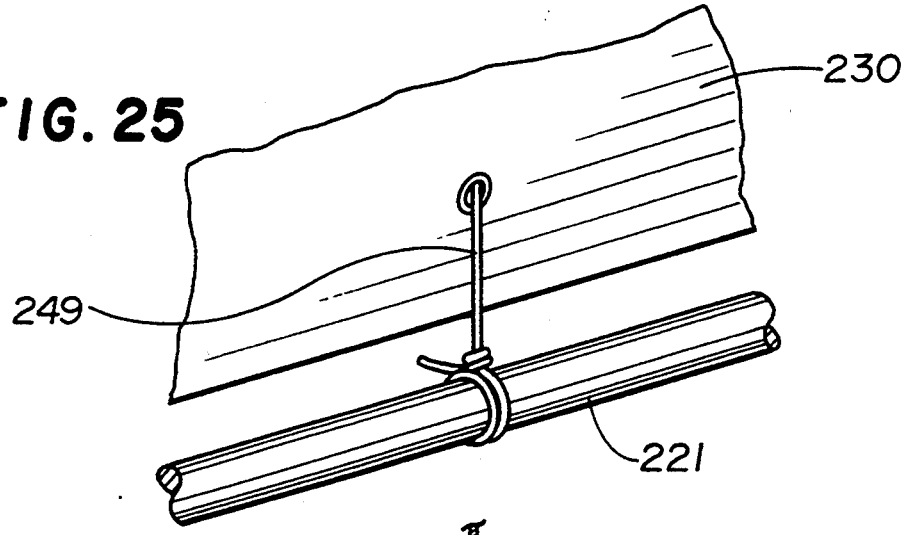
FIG. 25 is an enlarged perspective view of the connection of the sail flake line to the articulating sail boom.
Figure 26:
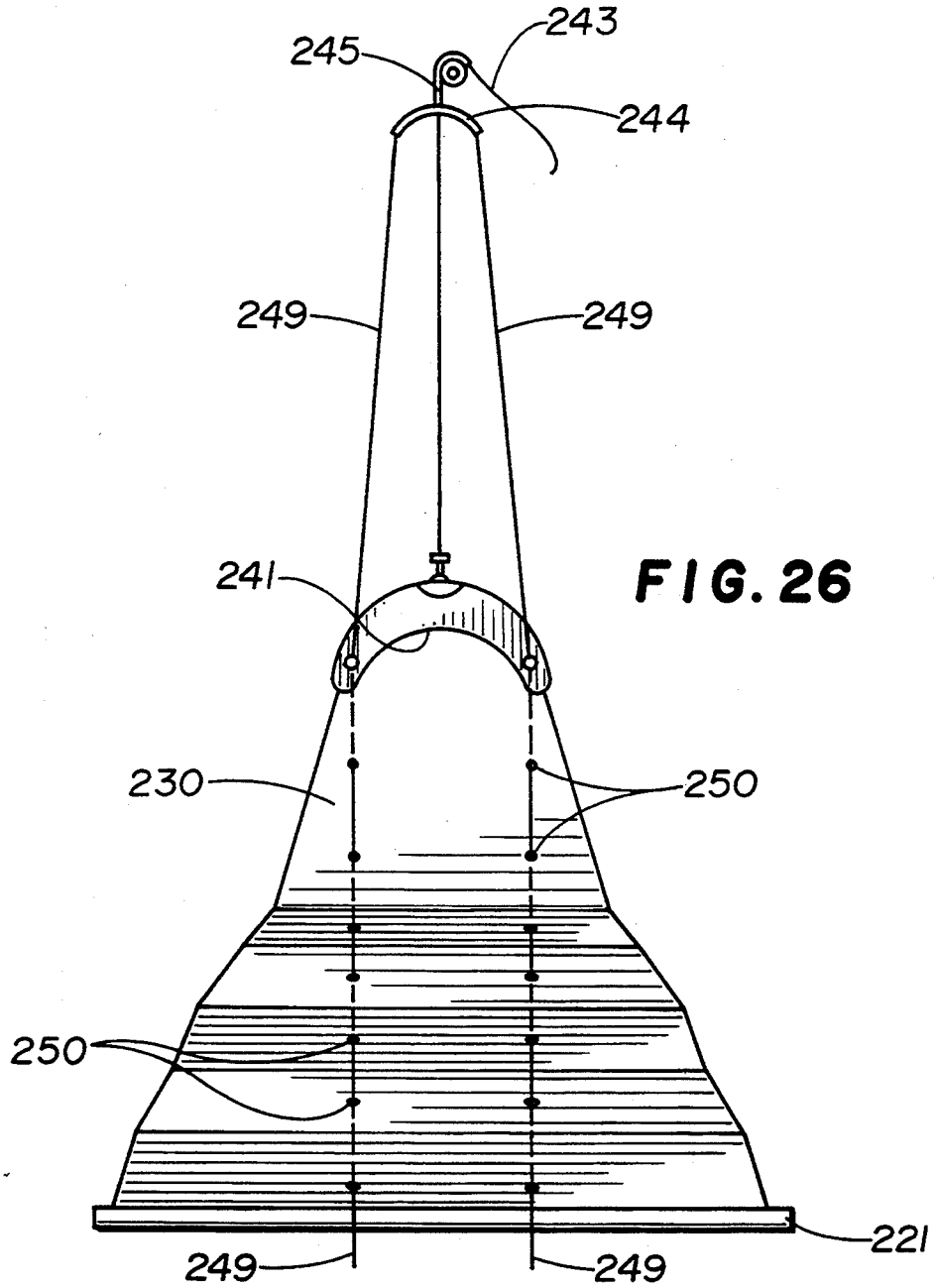
FIG. 26 is a perspective view showing the sail partially reefed.
Figure 27:
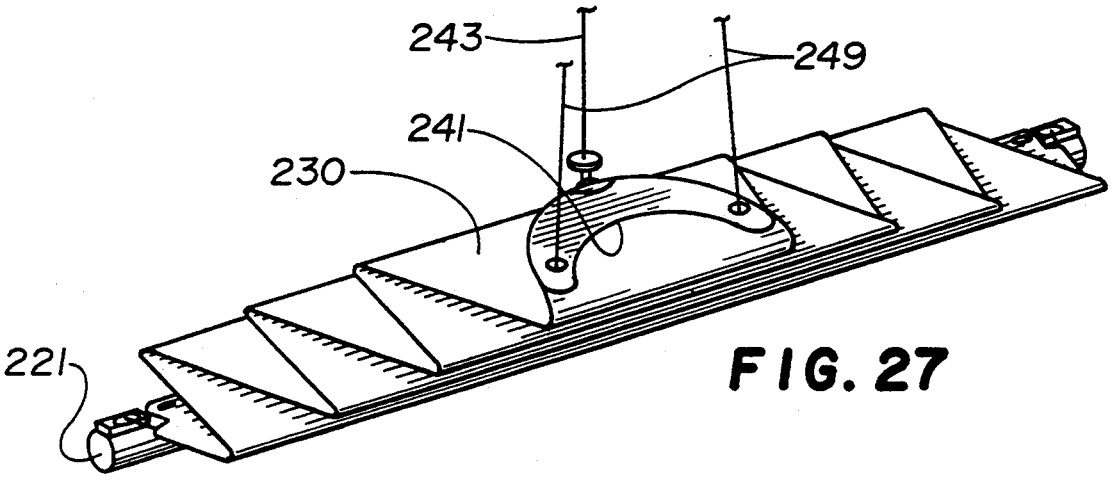
FIG. 27 is a perspective view showing the sail in a flaked down position.

The sail 230 is raised by pulling downwardly on the halyard 243 which lifts the top of the sail 241 to the swivel plate 244 at the top of the mast 241. Releasing the halyard 243, flakes the sail 230 downwardly along the flake lines 249 (FIG. 26–27). Battens 234 are formed at several locations on the sail 230 extending between the sides 242; Battens are not required at every crease on the sail 230. Without the flaking lines 249, the sail 230 would blow in an uncontrolled manner. The sail 230 folds in an accordion fashion and can be lowered to any desired height. The halyard 243 is wrapped around a halyard cleat 251 to secure the sail 230 at a selected position. The sail 230 also has a plurality of reef points 252 formed therein. The reef points 252 are spaced-apart openings in one or more rows, each now being substantially parallel to the foot of the sail 240. When the sail 230 is lowered to a point where the row of reef points 252 are near the sail boom 221, reefing ties can be inserted through the respective reef points 252 and tied around the sail boom 221 to retain the sail 230 in the lowered position (FIG. 28). The sailor may select which row of reef points 252 are used dependent upon the wind condition. Reefing is performed when the wind increases beyond the safe operation of the sailing craft with a full sail. Reefing reduces the sail area aloft by lowering the sail thereby reducing the overturning leverage of the sail and enabling the sailing craft to continue sailing safely under stronger wind conditions.

The sail 230 is made of a material which is chosen to suit the wind conditions which are anticipated. A stiffer material is used with stronger winds and a softer, more flexible material is used with weaker winds. In the event that the wind increases, the sail can be flaked (or reefed) to reduce the sail area and permit safer sailing.

Figure 29:
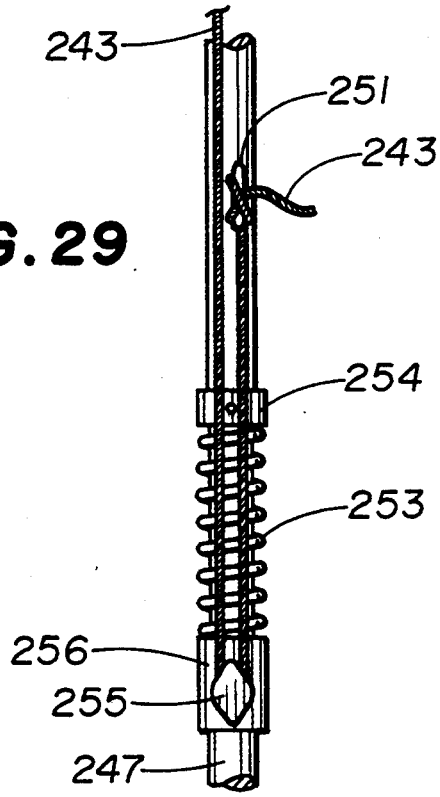
FIG. 29 is a side elevational view of the halyard tensioning device.

It is important to keep the tension on the sail 230 tight under all headings of the sailing craft and this may be accomplished by maintaining a constant tension on the halyard 243 which is connected to the top of the sail 241. Due to the slacking of the cam line 217, 218 as the sailing craft's heading changes with respect to the wind, the tension on the sail 230 is not constant without use of a tensioning device. In order to maintain tension on the sail 230, the halyard 243 has an end connected to the top of the sail 241 and an opposite end releasably connected to a tension device. As shown in FIG. 29, the tension device is preferably a circular spring 253 mounted on the mast 247 or other rigid member. The first end of the spring 253 is adjacent to a retaining stop 254, the retaining stop being connected to the mast 247 or rigid member. A pulley 255 or alignment eye is connected to the second opposite end of the spring 253. Preferably, the pulley 255 is connected to a slidable sleeve 256 which abuts the second end of the spring 253. The halyard 243 is routed from the top of the sail 241 through the pulley 255 and to the halyard cleat 251. In this manner, constant tension is applied to the top of the sail 241 by the urging of the spring 253 against the pulley 255 with the halyard 243 therein. The tension can be increased by pulling the halyard 243 through the pulley 255 to compress the spring 253 and by fastening the halyard. 243 to the halyard cleat 251 to maintain the compression. Alternately, by loosening the halyard 243 and reducing compression of the spring 253, tension on the sail 230 is reduced.

The single sail of the present invention mimics three commonly used sails i.e., the mainsail, the asymmetric sail and the spinnaker sail. The present invention acts as a mainsail when the sail is rotating on the boom with no line manipulation and can achieve all headings. When the rotating boom is approximately fore and aft on the hull's center line, and the aft cam line is released, the foot of the sail on the sail boom swings forward and assumes the attitude and shape of an asymmetric sail. The present sail acts as a spinnaker sail when the rotating boom is rotated across the center line of the hull and both cam lines are released. Thus, the sail boom and the foot of the sail move dramatically forward. When both outhauls are released, the sail becomes very similar in shape to a spinnaker sail running downwind.

The sail of the present invention has eliminated the mast from the sensitive leading edge of the sail thereby having a clean entry for higher pointing into the wind and for more efficient driving force with approximately 15% less sail area as compared to a conventional sail with a mast on the leading edge.

Several significant advantages are derived from the present invention as compared to conventional systems for sailing crafts. One major advantage is the ease with which a sailor can change the angle of the sail within 360° without handling winches and sheet lines simply by turning the helm sail or sail control ring. Due to this 360° rotation within the masts, the need to jibe is eliminated. This feature permits the sailing craft to turn much more rapidly, thereby saving time in racing events and reducing stress on the masts and sails. The sailing craft has the ability to sail backwards or to have the effect of braking due to its 360° trajectory (or orbit) of the sail. The load on the hull has been placed near the center of gravity, thereby lessening the weather helm.

Expressed another way, by exerting force broadside against the sailing craft, there is a point at which the sailing craft moves sideways with neither the bow or the stern being ahead of the other. This point is referred to as the center of lateral resistance (C.L.R.). There is another point at which the sail of the sailing craft is balanced to windward wherein, at 90° to the wind, nether the luff nor the leach of the sail, nor the head nor the foot of the sail, are ahead of the opposite member. This is substantially the area center of the sail and is referred to as the center of effort (C.E.).

In a conventional sailing craft, the sail C.E. moves as the sail pivots about the mast, but the centerboard or keel is stationary. This creates a weather helm or a lee helm as the sail shifts its C.E. In a weather helm, with the wind from the beam, the C.E. is aft of the C.L.R. and as a result, the sailing craft tends to "weather up" or turn to the windward. In a lee helm, with the wind from the beam, the C.E. is forward of the C.L.R., the sailing craft tends to be blown to the lee or down wind. With a strong wind from the stern, the sailing craft will yaw around or weather up in spite of the rudder setting. The C.E. is forward and abeam of the C.L.R. Contrary to the conventional sailing craft, in the sailing craft of the present invention, the C.E. is directly centered over the C.L.R. on all headings and the result is a very balanced, maneuverable and safe sailing craft.

As a result of the above design, a sailing craft is provided which is sailable by one person from one position amidships. The sailing craft is controlled and turned without stressing the sail and/or mast. The sail can easily be turned to "spill" the wind as desired. No complex, heavy and bulky block and tackle systems are required. The deck area is clear of jib sheet lines and winches when used with a sailboat, pitch, rock, roll and heeling are significantly reduced because the sail is centered on the sailing craft and the load on the edge of the sails is minimized. It is estimated that work required to operate the sailing craft of the present invention, as compared to a conventional sailboat, is reduced by approximately 80%.

The sailing craft 100 of the present invention may have a length of approximately twenty-four feet. The width is approximately twenty-two feet when the outboard hulls are secured outwardly and the width is approximately eight feet when the outboard hulls are moved inwardly for storage, transport and power sailing by an outboard motor. Also radio controlled models of the sailing craft 100 may be made having proportionally reduced length and widths.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. In a sailing craft, the combination of at least one hull having a bow and a stern in a longitudinal midplane a primary boom pivotally mounted on the at least one hull for 360° continuous rotation in either direction about a central vertical axis, a sail boom connected to the primary boom, at least one angled mast mounted on the at least one hull, extending upwardly therefrom, the at least one mast having a top, the top being disposed approximately above the central vertical axis of the primary boom, a sail carried by the sail boom, the sail extending upwardly therefrom, and substantially symmetrical about the central vertical axis, the sail being supported from the top of the at least one mast, such that the sail boom with the sail thereon has a completely free 360° rotation in either direction avoiding contact with the at least one mast.

2. The sailing craft of claim 1, further comprising the at least one hull having a deck, a port side and a starboard side, a cam having a base mounted on the hull deck at the central vertical axis, the cam being oriented toward the stern and disposed above the primary boom, the primary boom rotating about the base of the cam, the sail boom having a first end and an opposite second end, a first cam line connected from the cam to the first end of the sail boom, a second cam line connected from the cam to the second end of the sail boom, whereby when the primary boom rotates in a first direction, the first cam line is tightened and the second cam line is slackened, and when the primary boom rotates in a second opposite direction, the second cam line is tightened and the first cam line is slackened, whereby the luff and leach of the sail are interchangeable when the primary boom rotates through 180°.

3. The sailing craft of claim 2, wherein the slackened cam line has a length permitting movement of the sail boom through a predetermined distance port and starboard from the longitudinal midplane between the bow and the stern of the hull, said length being sufficient for tacking of the sailing craft without rotation of the primary boom and luffing through the wind preventing backwinding.

4. The sailing craft of claim 2, further comprising two cam cleats, a first cam cleat mounted on the first end of the sail boom and the second cam cleat mounted on the second end of the sail boom, each cam cleat having an alignment eye and a pair of interconnected jaws, the first cam line being received in the alignment eye and releasably retained in the jaws of the first cam cleat, the second cam line being received in the alignment eye and releasably retained in the jaws of the second cam cleat, wherein, pulling the respective cam line to release the respective cam line from the respective jaws, immediately pays out the sail boom for emergency situations and to depower the sail during knockdown, docking, and mooring.

5. The sailing craft of claim 1, further comprising the sail having a top, a halyard connected to the top of the sail, the halyard being routed from the top of the mast, along the mast to a halyard cleat connected to the mast, the halyard being pulled downwardly to raise the top of the sail to the top of the mast and the halyard being released to lower the sail.

6. The sailing craft of claim 5, further comprising a circular spring having a first end and a second end, the spring disposed around the mast, a retaining stop connected to the mast adjacent to the first end of the spring, a pulley attached to the second end of the spring, the halyard passing through the pulley and to the halyard cleat connected to the mast above the retaining stop, constant tension thereby being applied to the top of the sail.

7. The sailing craft of claim 1, further comprising the sail having a top, a foot and two sides therebetween, the foot being broader than the top, the foot of the sail being attached to the sail boom, a swivel plate attached to the top of the mast, a pair of sail flake lines, each sail flake line having a first end and a second end, the first ends of each sail flake line being attached to the swivel plate, a plurality of spaced-apart openings in the sail disposed in two parallel columns oriented from the top of the sail to the foot of the sail, each sail flake line passing through the openings in a respective column, the second ends of the respective flake lines being attached to the sail boom, wherein entanglement and twisting of the flake lines are avoided when the sail rotates through 360° in either direction.

8. The sailing craft of claim 7, further comprising a hollow halyard tube connected to the swivel plate and extending upwardly therefrom, a halyard having a first end and a second end, the first end being connected to the top of the sail, the halyard passing through the halyard tube, the second end of the halyard extending downwardly toward the hull, wherein the halyard being pulled downwardly raises the top of the sail, the halyard being released flakes the sail downwardly along the flake lines.

9. The sailing craft of claim 1, further comprising a plurality of spaced-apart reef point openings in the sail, the openings being disposed in at least one row substantially parallel to the foot of the sail, a corresponding plurality of reefing ties, one of said reefing ties being disposed in each reef point opening and being tied around the sail boom when the sail is lowered.

10. The sailing ,craft of claim 1, wherein the sailing craft is a trimaran having a center hull, an outboard starboard hull and an outboard port hull.

11. A sailing craft having at least one hull, the hull having a deck, a port side, a starboard side, a bow and a stern in a horizontal plane, a primary boom pivotally mounted on the at least one hull for 360° continuous rotation in either direction about a central vertical axis, a sail boom connected to the primary boom, at least one angled mast mounted on the at least one hull, the mast extending upwardly therefrom, the at least one mast having a top, the top being disposed approximately above the central vertical axis of the primary boom, a sail carried by the sail boom, the sail extending upwardly therefrom and substantially symmetrical about the central vertical axis, the sail being supported from the top of the at least one mast; a cam having a base mounted on the hull deck at the central vertical axis, the cam being oriented toward the stern and disposed above the primary boom, the primary boom rotating about the base of the cam, the sail boom having a first end and an opposite second end, a first cam line connected from the cam to the first end of the sail boom, a second cam line connected from the cam to the second end of the sail boom, whereby when the primary boom rotates in a first direction, the first cam line is tightened and the second cam line is slackened, and when the primary boom rotates in a second opposite direction, the second cam line is tightened and the first cam line is slackened, whereby the luff and leach of the sail are interchangeable when the primary boom rotates through 180°, the ends of the sail boom and the sail avoiding contact with the at least one mast.

* * * * *